US007927151B2

(12) United States Patent
Prest et al.

(10) Patent No.: US 7,927,151 B2
(45) Date of Patent: Apr. 19, 2011

(54) AUDIO PLUG WITH CORE STRUCTURAL MEMBER

(75) Inventors: Christopher D. Prest, Mountain View, CA (US); Matthew Rohrbach, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/479,404

(22) Filed: Jun. 5, 2009

(65) Prior Publication Data

US 2010/0311281 A1 Dec. 9, 2010

(51) Int. Cl.
*H01R 24/04* (2006.01)

(52) U.S. Cl. ..... 439/669

(58) Field of Classification Search ..... 439/669, 439/668

See application file for complete search history.

(56) References Cited

U.S. PATENT DOCUMENTS

| | | | | |
|---|---|---|---|---|
| 3,289,149 | A | 11/1966 | Pawloski | |
| 3,318,785 | A | 5/1967 | Armstrong et al. | |
| 5,911,601 | A * | 6/1999 | Weingartner | 439/669 |
| 6,224,409 | B1 | 5/2001 | Chang | |
| 6,390,856 | B1 | 5/2002 | D'Addario et al. | |
| 6,439,933 | B1 * | 8/2002 | Moji | 439/669 |
| 6,616,487 | B1 * | 9/2003 | Lai | 439/668 |
| 6,912,423 | B2 * | 6/2005 | Ley et al. | 607/37 |
| 7,351,113 | B2 | 4/2008 | Lee et al. | |
| 7,404,743 | B2 * | 7/2008 | Chen et al. | 439/669 |
| 7,833,055 | B2 | 11/2010 | Crooijmans et al. | |
| 2003/0207603 | A1 | 11/2003 | Potega | |
| 2006/0148314 | A1 | 7/2006 | Castaneda et al. | |
| 2009/0004923 | A1 * | 1/2009 | Tang et al. | 439/660 |
| 2009/0061694 | A1 * | 3/2009 | Kawasaki et al. | 439/669 |
| 2009/0081906 | A1 | 3/2009 | Lynch et al. | |
| 2009/0311915 | A1 * | 12/2009 | Stiehl | 439/669 |

FOREIGN PATENT DOCUMENTS

WO 2007038895 A1 4/2007

* cited by examiner

*Primary Examiner* — Gary F. Paumen
(74) *Attorney, Agent, or Firm* — Kramer Levin Naftalis & Frankel LLP

(57) ABSTRACT

Plugs with core structural members and methods for manufacturing plugs with core structural members are provided. A plug can include a core structural member that may increase the structural integrity of the plug. The plug can further include contact pads and traces, and each trace can electrically couple with one of the contact pads and extend along a plug axis towards the proximal end (e.g., base section) of the plug. In orientation-specific embodiments, the traces may be disposed on the surface of the plug. However, in other embodiments, the traces may be disposed below but near the surface of the plug. The plug may also include one or more insulating layers to prevent contact pads and traces from shorting.

29 Claims, 15 Drawing Sheets

AUDIO PLUG WITH CORE STRUCTURAL MEMBER

BACKGROUND OF THE INVENTION

Traditional audio plugs (i.e., male connectors) can have structural limitations. Each contact of an audio plug is typically a ring of metal with a thin lead. During manufacture, the rings are assembled so that each ring's lead extends through the center of other rings towards the plug's base and plastic is then injection-molded into the center of the rings. This manufacturing technique creates a plug core consisting of several thin leads separated by injection-molded plastic. While such a core insulates the leads from each other and the other contacts, this structure may have a limited resistance to bending or other forces applied to the plug.

SUMMARY OF THE INVENTION

Improved plugs and methods for manufacturing improved plugs are provided. A plug can include a structural member that may increase the structural integrity of the plug. The plug can further include contact pads and traces, and each trace can electrically couple with one of the contact pads and extend along a plug axis towards the proximal end (e.g., base section) of the plug. In orientation-specific embodiments, the traces may be disposed on the surface of the plug. However, in other embodiments, the traces may be disposed below but near the surface of the plug. The plug may also include one or more insulating layers to prevent contact pads and traces from shorting.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Figure 1A:
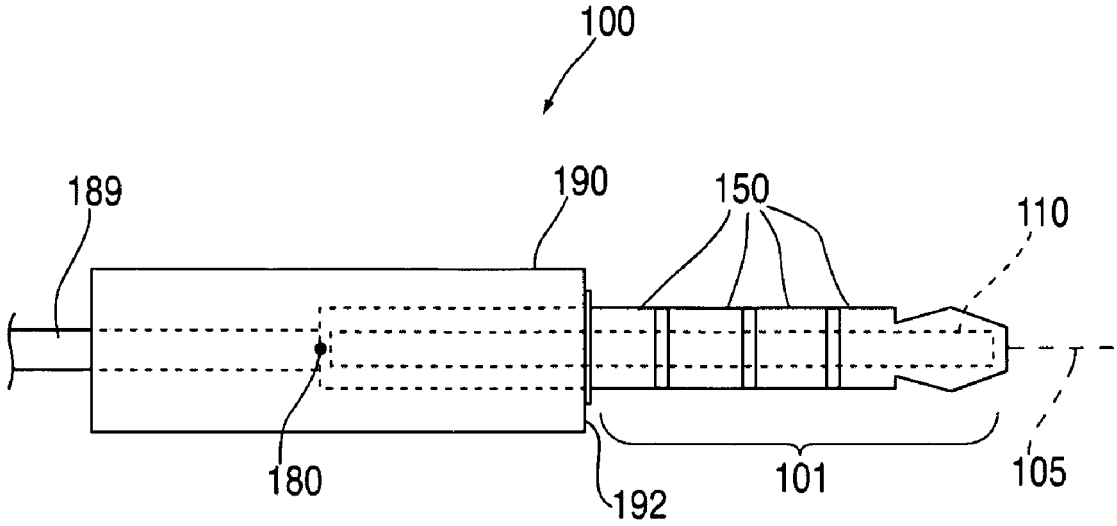
FIG. 1A is a perspective view of an illustrative male connector in accordance with one embodiment of the invention.

FIG. 1 includes male connector 100 in accordance with one embodiment. Male connector 100 may, for example, include functionality related to audio signals, visual signals, data signals, or other electrical signals. Male connector 100 may include an elongated plug 101 that extends axially from a proximal to distal end along axis 105. Plug 101 may include one or more contacts 150 that are spaced apart axially between the proximal and distal ends. While the embodiment shown in FIG. 1 includes four contacts, any number of contacts may be used depending on the needs of the male connector. For example, the number of contacts included in a plug may be based on how many electrical signals will be transmitted through the plug. In an embodiment for coupling with audio headsets with integrated microphones, four contacts may be used to provide outgoing audio signals in stereo, receive an incoming microphone signal, and form a ground circuit. In an audio/video connector embodiment, the four contacts may be used to form a group circuit and provide or receive audio signals in stereo as well as composite video. In a Universal Serial Bus (USB) embodiment, four contacts may be used to form a ground and power circuit and provide and receive a differential data signal. In a Firewire embodiment, six contacts may be used to form a group and power circuit and provide and receive two differential data signals.

In some embodiments, a connector can include a housing with a mating surface. For example, connector 100 can include housing 190 with mating surface 192 for abutting a corresponding mating surface in a female connector when the two connectors are coupled together. Referring to FIG. 1B, male connector 100 can couple with female connector 102 by inserting plug 101 into jack 103 (e.g., an aperture) in the female connector. When the two connectors are coupled together, mating surface 192 on male connector 100 abuts mating surface 194 on female connector 102. Moreover, when the two connectors are coupled together, contacts 151 disposed within jack 103 may couple with contacts 150 on plug 101. Contacts 151 may, for example, be electrical contacts configured to extend into jack 103 (e.g., coupled with a spring) so that contacts 151 engage contacts 150 on plug 101. Contacts 151 may be spaced apart so that each contact will only couple with a single contact on plug 101. Contacts in a female connector may be coupled with a cable, printed circuit board, or any other similar device. For example, contacts 151 may be coupled with printed circuit board 159, and an electronic device that includes female connector 102 can receive electrical signals from another device that includes male connector 100.

Referring back to FIG. 1A, male connector 100 may include termination point 180 where plug 101 may be operatively and structurally coupled to a cable, printed circuit board, or any other similar device. For example, plug 101 may couple with cable 189 at termination point 180. In some embodiments, a connector may include a strain relief to make a structurally robust connection between a plug and a cable, printed circuit board, or other similar device. For example, termination point 180 may include a strain relief to strengthen the connection between plug 101 and cable 189. In some embodiments, a termination point may be covered by a housing, body, or enclosure. For example, termination point 180 may be covered by housing 190. In embodiments including a cable (e.g., connector 100), a housing may form a portion of the strain relief. A more detailed description of suitable connector housings and strain reliefs can be found in U.S. patent application Ser. No. 12/218,450, entitled "Audio Plug with Cosmetic Hard Shell" and filed on Jul. 14, 2008, which is incorporated by reference herein in its entirety.

In some embodiments, plug 101 can be configured with core structural member 110 (shown in dotted lines) to provide an extremely robust male connector 100. For example, core structural member 110 may prevent plug 101 from bending. Structural member 110 may be disposed entirely or partially along the length of elongated plug 101. For example, a structural member can be a cylindrical component extending through the center of the plug. In some embodiments, structural member 110 may extend proximally past at least the distal end of housing 190 (e.g., mating surface 192) and further proximate towards, and possibly abutting, terminal point 180. In one particular embodiment, structural member 110 may substantially extend from the distal end of plug 101 to at least termination point 180.

In order to provide connections between contacts and the termination point, a plug may include one or more conductive paths (e.g., traces) that extend between the contacts and the termination point. In order to accomplish this, the outer surface of the plug may be configured with a dielectric material so that the conductive paths can run through or on the plug while being electrically separated from the contacts and, potentially, the core structural member.

In one embodiment, a core structural member may be formed from a metal such as steel, and the metal structural member may be substantially encapsulated by an insulating dielectric layer. In such an embodiment, the contacts may be disposed on the outer surface of the insulating layer. Accordingly, the plug may be a composite plug that includes multiple materials. For example, a conductive material may be deposited onto the surface of the insulating dielectric layer to form one or more contacts. Moreover, traces may be disposed on the insulating layer, within the insulating layer, underneath the insulating layer, or any combination thereof. The contacts and/or the traces may be insulated from the core structural member and each other by the insulating dielectric layer.

Figure 1B:
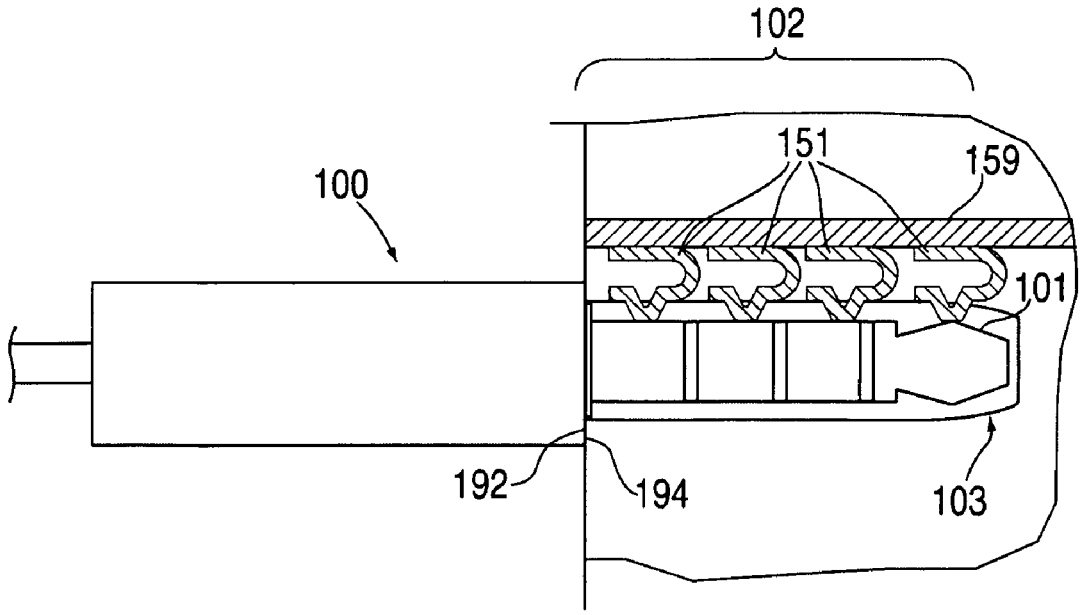
FIG. 1B is a perspective view of an illustrative male connector inserted into a cross-section of a female connector in accordance with one embodiment of the invention.
Figure 2A:
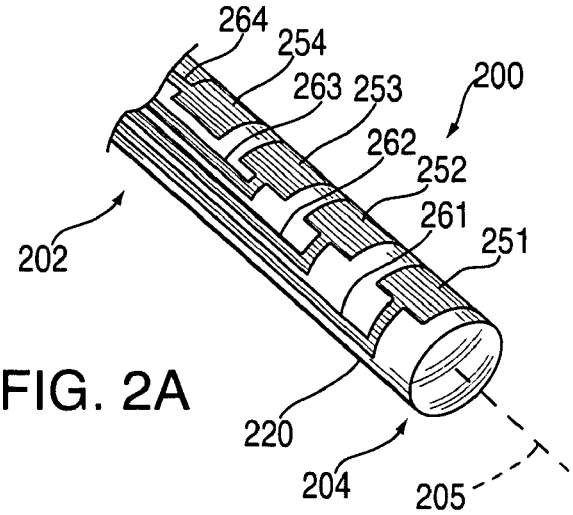
FIG. 2A is a perspective view of an illustrative plug in accordance with one embodiment of the invention.
Figure 2B:
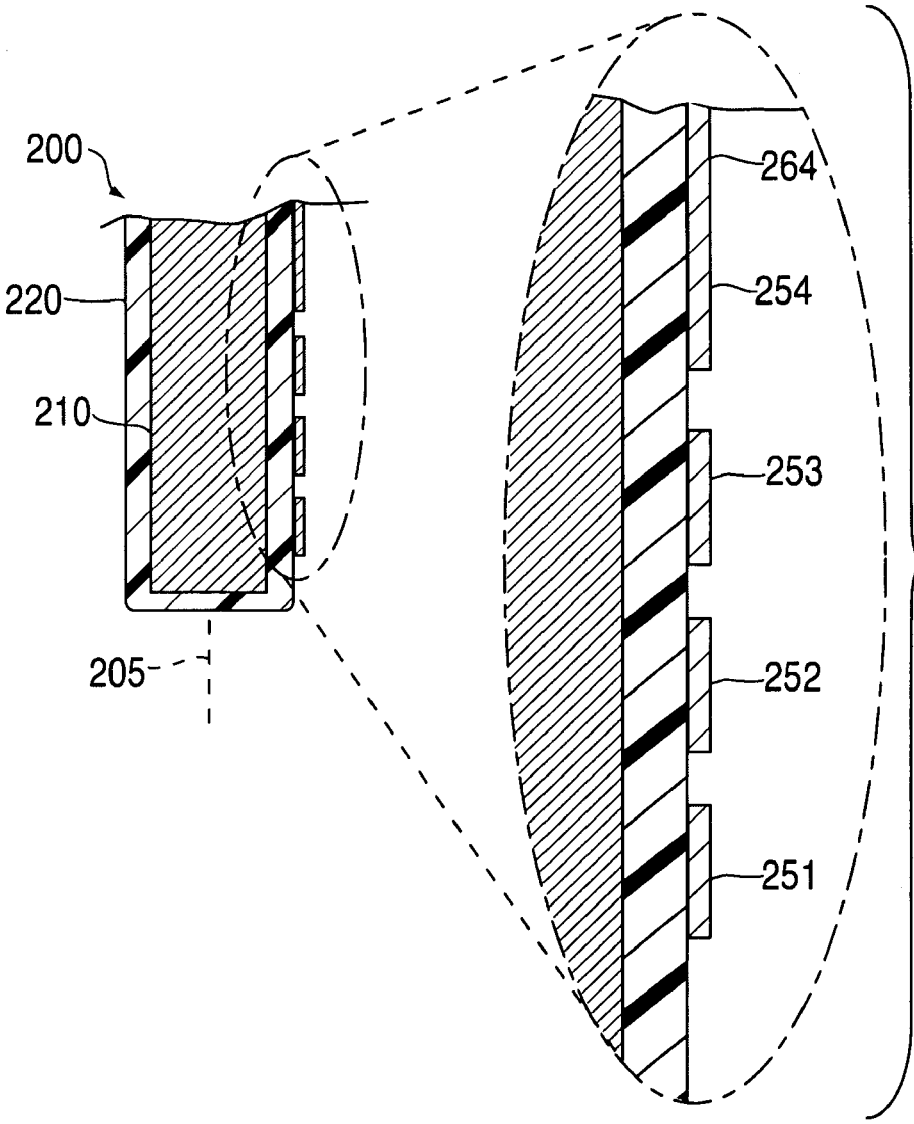
FIG. 2B is a cross-sectional view of an illustrative plug in accordance with one embodiment of the invention.

FIGS. 2A and 2B include plug 200 with traces on the outer surface of the plug in accordance with one embodiment. Plug 200 can be provided on any male connector (e.g., connector 100 of FIG. 1A) for coupling with a female connector (e.g., connector 102 of FIG. 1B). For example, plug 200 can be provided on a connector for a pair of headphones, a pair of earbuds, an external speaker, a charging device, a cable that couples a personal computer with an electronic device (e.g., a Universal Serial Bus cable), a cable that couples a video display with an electronic device, or any other suitable male connector that couples with a female connector. Moreover, plug 200 can be provided for transmitting audio signals, video signals, data signals, or any other suitable types of electrical signal. Plug 200 can be used to couple with a female connector on any suitable electronic device, including, for example, a digital music player or a communications device (e.g., a cellular telephone).

Plug 200 can be sized and shaped to mate with a jack in an electronic device. Plug 200 can have an elongated shape extending along plug axis 205. Along plug axis 205, plug 200 can include proximal end 202 (e.g., a base section) and distal end 204 (e.g., a tip section). While the plug embodiment shown in FIG. 2 may have an elongated shape, it is understood that a plug can have any suitable shape for mating with a jack in an electronic device. For example, a plug (e.g., plug 200) can have a shape similar to plug 101 of FIGS. 1A and 1B. Moreover, while the distal end of the plug embodiment shown in FIG. 2 may have a relatively smooth surface, it is understood that the distal end of a plug can have any suitable shape. For example, the distal end of a plug (e.g., distal end 204) can have a shape similar to the distal end of plug 101 of FIGS. 1A and 1B.

As seen in the cross-section view of FIG. 2B, plug 200 includes core structural member 210 extending along plug axis 205. Structural member 210 can be formed from a rigid material. In some embodiments, structural member 210 can be formed from a metal. For example, structural member 210 can be formed from steel, aluminum, titanium, or any other suitable metal or alloy. In some embodiments, structural member 210 may be a solid piece of rigid material that is formed by turning, machining, forging, casting, any other suitable manufacturing technique, or any combination thereof. In some embodiments, structural member 210 may be shaped to increase its structural integrity. For example, structural member 210 may have a length, width, length-to-width ratio, or any other dimension or characteristic that provides structural integrity. Structural member 210 can add structural integrity to plug 200.

Plug 200 can include insulating layer 220 that may be formed from a dielectric material. Insulating layer 220 may surround, encapsulate or cover core structural member 210. In some embodiments, insulating layer 220 may be formed by coating structural member 210 with a dielectric material. Insulating layer 220 may be formed from ceramic, polycarbonate, polyethylene, polystyrene, or any other suitable dielectric material. Insulating layer 220 can, for example, insulate any contact pads or traces on the outer surface of the plug from each other. In some embodiments, the insulating layer 220 can be a relatively large portion of the outer surface of plug 200.

Plug 200 can include one or more contact pads (e.g., contact pads 251, 252, 253, and 254). Contacts pads 251-254 can be located on or disposed over the outer surface of insulating layer 220. Contact pads 251-254 can be spaced along axis 205 so that each contact pad is located at a different point along the axis. Contact pads 251-254 can extend circumferentially around axis 205 to cover a portion of the circumference of plug 200. For example, contact pads 251-254 may extend 20% around the circumference of plug 200. In another example, contact pads 251-254 may extend up to 50% around the circumference of plug 200. In yet another example, contact pads 251-254 may extend up to 75% around the circumference of plug 200. In yet a further example, contact pads 251-254 may extend up to 90% around the circumference of plug 200.

Contact pads 251-254 can be formed from a conductive material. For example, contact pads 251-254 may be formed by depositing a conductive material onto insulating layer 220. Contact pads 251-254 may be sufficiently thick enough to withstand forces from mating with a female connector (e.g., frictional forces from inserting plug 200 in a jack and withdrawing plug 200 from a jack). In some embodiments, contact pads 251-254 may protrude from the outer surface of insulating layer 220.

Each of contact pads 251-254 can be sized and shaped to mate with a corresponding contact in a female connector. Moreover, the array of contact pads 251-254 may be arranged to mate with an array of contacts in a female connector (e.g., contacts 151 in connector 102 of FIG. 1B). In some embodiments, contact pads 251-254 may be arranged in a straight line along one side of plug 200 that corresponds to an array of contacts along one side of a female connector. In another example, contact pads may be arranged on different sides of plug 200 so that the contact pads correspond to an array of contacts on different sides of a female connector.

Plug 200 can include traces 261, 262, 263, and 264 formed from a conductive material. Traces 261-264 can be located on or disposed over the outer surface of insulating layer 220. Insulating layer 220 may insulate each of traces 261-264 from the other traces and structural member 210. Each of traces 261-264 may electrically couple with one of contact pads 251-254. For example, trace 261 may electrically couple with contact pad 251, trace 262 may electrically couple with contact pad 252, and so forth. Each of traces 261-264 may be directly coupled with one of contact pads 251-254 by overlapping the contact pad, either above or below the contact pad, or abutting against the edge of the contact pad. In some embodiments, traces 261-264 and contact pads 251-254 may be integral parts of a single layer and, therefore, inherently coupled.

In some embodiments, traces 261-264 may be formed in the same manner as contact pads 251-254. For example, traces 261-264 and contact pads 251-254 may be formed in a single manufacturing step (e.g., depositing conductive material on the outer surface of insulating layer 220). In such embodiments, traces 261-264 may be formed from the same material as contact pads 251-254. In other embodiments, traces 261-264 may be formed in a different manner and/or at a different time than contact pads 251-254. For example, traces 261-264 may be formed from a different material than contact pads 251-254. Moreover, traces 261-264 may be formed before or after contact pads 251-254 are formed.

In some embodiments, traces 261-264 may be the same thickness as contact pads 251-254. For example, traces 261-264 may be formed using the same process used to form contact pads 251-254 and both the traces and contact pads may have the same thickness. In other embodiments, traces 261-264 may be thinner than contact pads 251-254. For example, traces 261-264 may not necessarily be as thick as contact pads 251-254 because traces 261-264 do not undergo the same forces when mating with a female connector (e.g., frictional forces) as contact pads 251-254.

In some embodiments, each of traces 261-264 can be located the same distance from axis 205 (e.g., at the same radius or radial layer) as the other traces. For example, insulating layer 220 may be centered around plug axis 205 so that traces 261-264 are the same radial distance from plug axis 205 when deposited on insulating layer 220. In other words, traces 261-264 may all be on the same radial layer. In some embodiments, each of traces 261-264 can be located the same distance from axis 205 (e.g., at the same radius or radial layer) as contact pads 251-254 as well as the other traces.

While an array of contact pads may be arranged to mate with an array of contacts in a female connector, the corresponding traces may be arranged so that they will not couple with any of the contacts in the female connector. For example, contact pads 251-254 and traces 261-264 may be arranged on the surface of plug 200 so that each of contact pads 251-254 mates with a different contact in a female connector while none of traces 261-264 couple with the contacts. In some embodiments, the traces on a plug may be less thick than the contact pads on the plug so that, when the plug is inserted into a female connector, the traces will not touch the connector.

Figure 3A:
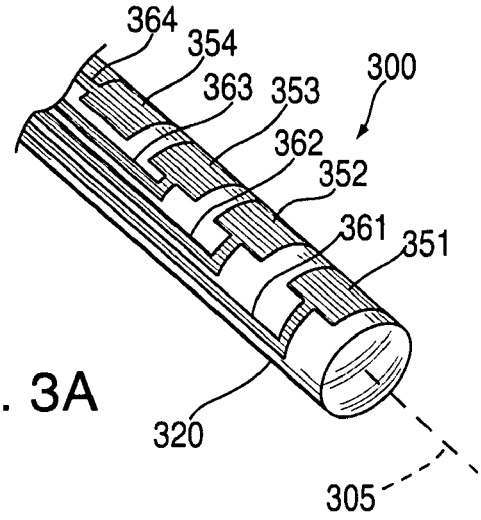
FIG. 3 is a cross-sectional view of an illustrative plug in accordance with one embodiment of the invention.
Figure 3B:
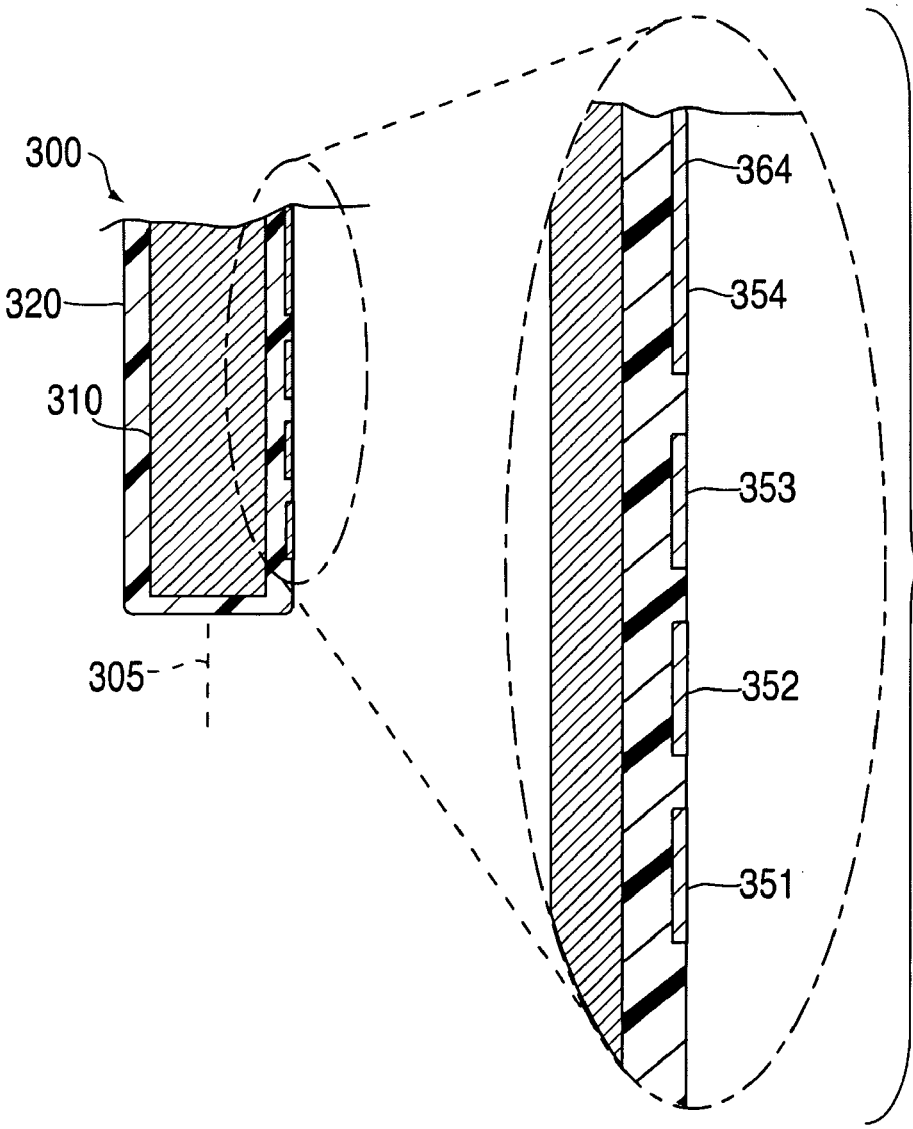

In some embodiments, contact pads and traces may be substantially flush with the outer surface of a plug. FIGS. 3A and 3B include plug 300 with contact pads and traces substantially flush with the outer surface of the plug in accordance with one embodiment. Plug 300 can be substantially similar to plug 200 of FIGS. 2A and 2B. For example plug 300 can include core structural member 310 extending along plug axis 305, and structural member 310 may be substantially similar to structural member 210 of plug 200. Plug 300 may also include insulating layer 320 that is similar to insulating layer 220 of plug 200 but, unlike insulating layer 220 and the contact pads and traces disposed thereon, the outer surface of insulating layer 320 may be substantially flush with contact pads 351-354 and traces 361-364.

In some embodiments, one or more indentations can be provided in insulating layer 320 (e.g., by chemical or laser etching), and conductive material can be deposited in the indentations to create contact pads 351-354 and traces 361-364 that are substantially flush with the outer surface of insulating layer 320. In other embodiments, contact pads 351-354 and traces 361-364 may be deposited onto insulating layer 320, and then additional dielectric material may be deposited over insulating layer 320 to make it substantially flush with the contact pads and traces.

Figure 4:
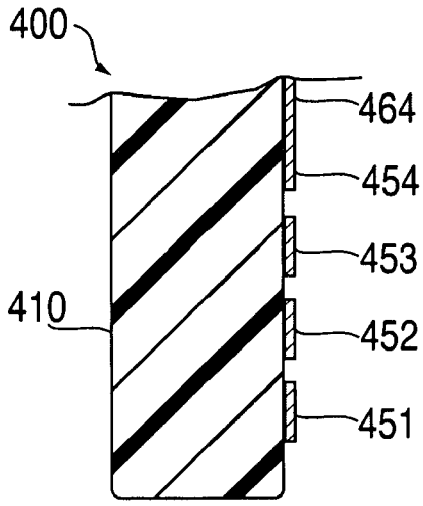
FIG. 4 is a cross-sectional view of an illustrative plug in accordance with one embodiment of the invention.

In some embodiments, a plug may include a structural member with insulating properties rather than a structural member and an insulating layer covering the structural member. FIG. 4 includes plug 400 with structural member 410 in accordance with one embodiment. Plug 400 can be provided on any male connector for coupling with a female connector. Plug 400 can be similar to plug 200 of FIGS. 2A and 2B, and plug 400 may include many of the same elements as plug 200. For example, plug 400 can include contact pads 451-254 (see, e.g., contact pads 251-254 of plug 200) and traces (see, e.g., traces 261-264 of plug 200). While only trace 464 is shown in FIG. 4, it is understood that plug 400 can include other traces on the outer surface of plug 400. For example, plug 400 may include three other traces and each of the traces may electrically couple with one of contact pads 451-453 (see, e.g., traces 261-263 provided on plug 200).

Unlike plug 200, plug 400 may not include a separate core structural member and insulating layer covering the structural member. For example, plug 400 may include core structural member 410 that can provide structural integrity while also forming the outer surface of plug 400. A separate insulating layer may not be necessary if structural member 410 is formed from a dielectric material. For example, structural member 410 may be formed from ceramic, polycarbonate, polyethylene, polystyrene, or any other suitable dielectric material. In some embodiments, structural member 410 may be formed from a rigid dielectric material that will increase the structural integrity of plug 400. In some embodiments, structural member 410 may be a solid piece of rigid dielectric material that is formed by any suitable manufacturing technique. In some embodiments, structural member 410 may be shaped to increase its structural integrity. For example, structural member 410 may have a length, width, length-to-width ratio, or any other dimension or characteristic that provides structural integrity. Structural member 410 may also provide structural integrity by acting as the core or inner member of plug 400.

While the embodiment shown in FIG. 4 includes a core structural member formed from a single dielectric material, it is understood that an structural member can be formed from multiple dielectric materials depending on the needs of the system. For example, a structural member can include an inner core with dielectric and structural characteristics and an outer layer with a texture that is advantageous for receiving conductive material to form contact pads and traces.

To couple plug contacts pads with a cable, printed circuit board, or other suitable device, conductive paths (e.g., traces) may extend at least partially along a plug's axis towards the proximal end of the plug. In some embodiments, traces can be spaced around the plug's axis so that each trace is located at a different position around the axis. For example, one or more of the traces can extend circumferentially around a plug's axis to avoid contact pads and the other traces. Referring to plug 200 in FIG. 2A, trace 264 may couple with contact pad 254 and extend directly along plug axis 205 towards proximal end 202, while trace 263 may couple with contact pad 253, extend at least partially around plug axis 205 to avoid contact pad 254, and then extend along plug axis 205 towards proximal end 202.

Figure 5:
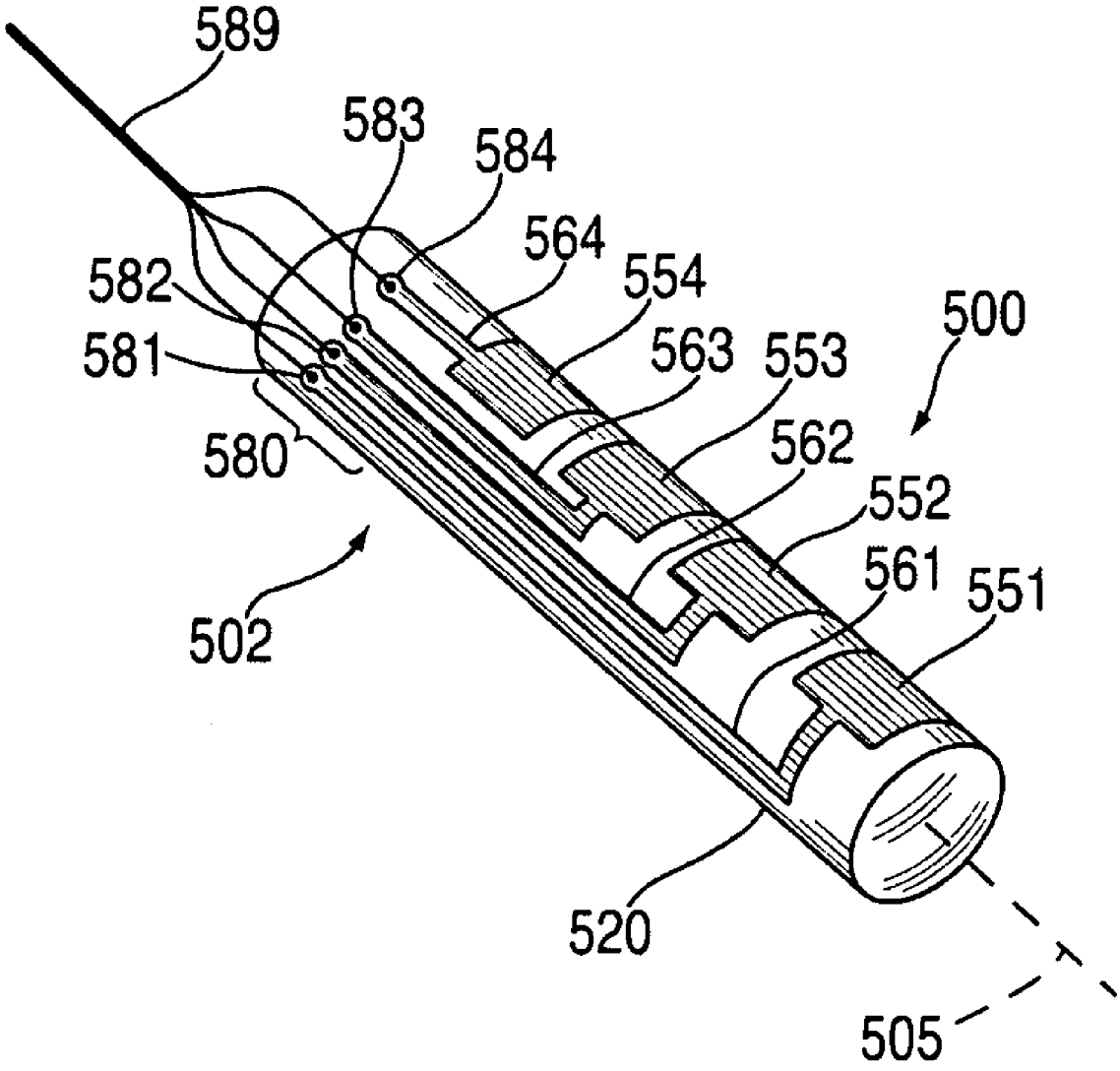
FIG. 5 is a perspective view of an illustrative plug in accordance with one embodiment of the invention.

A plug's traces can extend beyond the plug's proximal end for coupling with a cable, printed circuit board, or other suitable device (e.g., cable 189 of FIG. 1A). For example, referring to FIG. 2A, each of traces 261-264 may extend beyond proximal end 202 and end in a terminating contact pad (e.g., a solder pad) for electrically coupling with a line in a cable or a circuit board in an accessory. FIG. 5 includes plug 500 with termination point 580 in accordance with one embodiment. Plug 500 can be provided on any male connector for coupling with a female connector. Plug 500 can be similar to plug 200 of FIGS. 2A and 2B, plug 300 of FIG. 3 and plug 400 of FIG. 4. Plug 500 may include many of the same elements as plugs 200, 300, and 400. For example, plug 500 can include contact pads 551-554 (see, e.g., contact pads 251-254 of plug 200) and traces 561-564 (see, e.g., traces 261-264 of plug 200). Each of traces 561-564 can extend along plug axis 505 towards proximal end 502 of plug 500. Plug 500 may include termination point 580 at proximal end 502 of the plug, and each of traces 561-564 may end at the termination point. At termination point 580, each of traces 561-564 can couple with a line in a cable, a trace on a printed circuit board, or any other suitable electrical line. For example, termination point 580 can include multiple solder pads 581-584 for coupling with various lines in cable 589. While the embodiment shown in FIG. 5 include solder pads for coupling with lines in a cable, it is understood that any other suitable connection technique can be used to couple a termination point with a cable, printed circuit board, or other suitable device.

Figure 6A:
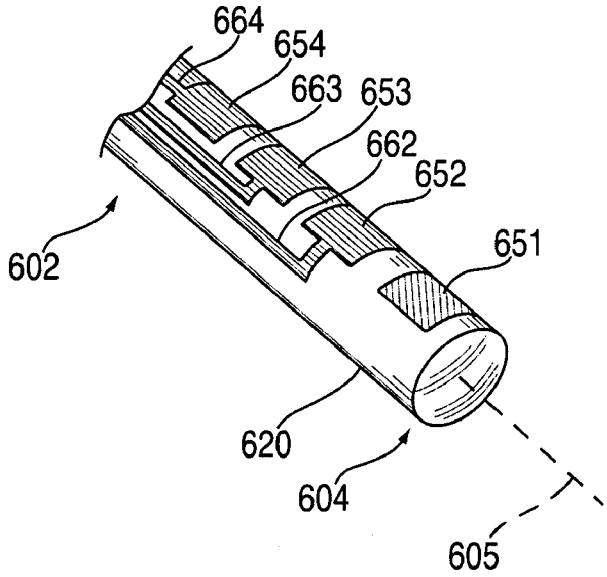
FIG. 6A is a perspective view of an illustrative plug in accordance with one embodiment of the invention.
Figure 6B:
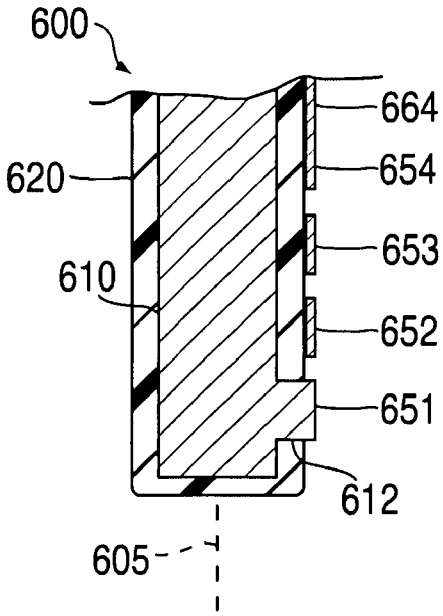
FIG. 6B is a cross-sectional view of an illustrative plug in accordance with one embodiment of the invention.

In some embodiments, a plug may include a structural member that functions as a conductive path for a contact pad. FIGS. 6A and 6B include plug 600 with structural member 610 in accordance with one embodiment. Plug 600 can be provided on any male connector for coupling with a female connector. Plug 600 can be similar to plug 200 of FIGS. 2A and 2B, and plug 600 may include many of the same elements as plug 200. For example, plug 600 can include contact pads 652-654 (see, e.g., contact pads 252-254 of plug 200) and traces 662-664 (see, e.g., traces 262-264 of plug 200).

Unlike plug 200, plug 600 may include structural member 610 that functions as a conductive path for contact pad 651. Structural member 610 may be formed from a rigid material with conductive properties. For example, structural member 610 may be formed from steel or any other suitable metal or alloy with conductive properties. Beyond proximal end 602, structural member 610 may electrically couple with a cable or an accessory (not shown). For example, the proximal end of structural member 610 may include a terminating contact pad (e.g., a solder pad) for electrically coupling with a line in a cable or a circuit board in an accessory. Moreover, structural member 610 may include protrusion 612 extending radially away from plug axis 605.

In the embodiment shown in the cross-section view of FIG. 6B, the tip of protrusion 612 may form contact pad 651. In such an embodiment, insulating layer 620 may cover structural member 610 except for the end of protrusion 612, which may extend past the outer surface of insulating layer 620. Accordingly, the end of protrusion 612 may form contact pad 651 that may be flush with contact pads 652-654.

In other embodiments, contact pad 651 may be formed on top of the tip of protrusion 612. For example, the tip of protrusion 612 may be substantially flush with the outer surface of insulating layer 620 and a conductive material can be applied over the tip of protrusion 612 and a surrounding section of insulating layer 620 to form contact pad 651. In such embodiments, once the tip of protrusion 612 is substantially flush with the outer surface of insulating layer 620, contact pads 651-654 may be formed using the same process (see, e.g., discussion of contact pads 251-254).

In the embodiment shown in FIGS. 6A and 6B, structural member 610 may be a conductive path for contact pad 651 near distal end 604 of plug 600 but, in other embodiments, it is understood that a structural member may be a conductive path for any other contact pad on plug 600, including contact pads closer to proximal end 602. Moreover, in other embodiments, a structural member may not include a protrusion, and a plug may include one or more conductive vias extending through an insulating layer and electrically coupling a contact pad with a structural element.

Figure 7:
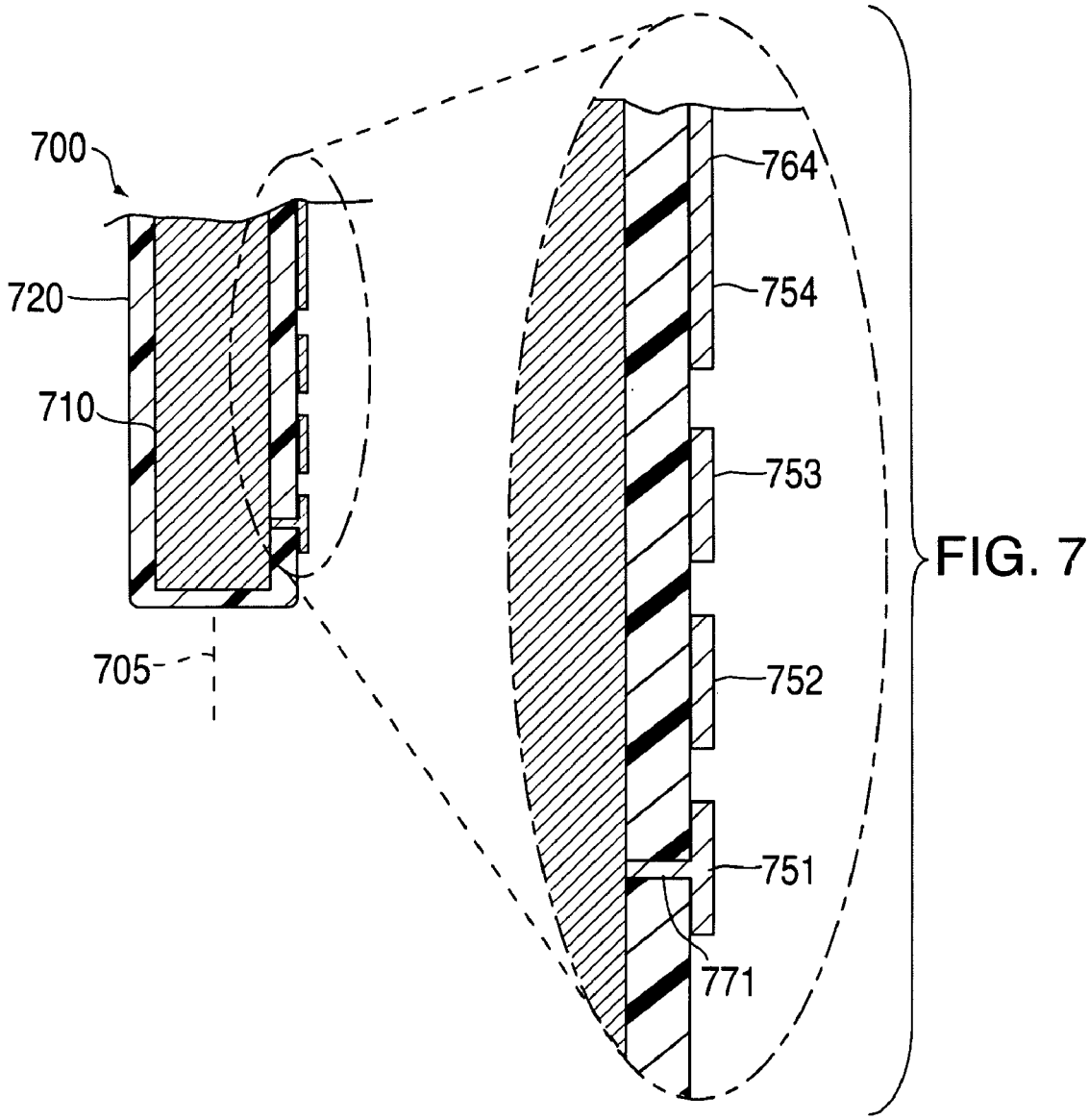
FIG. 7 is a cross-sectional view of an illustrative plug in accordance with one embodiment of the invention.

FIG. 7 includes plug 700 with conductive path 771 coupling structural member 710 and contact pad 751 in accordance with one embodiment. Plug 700 can be provided on any male connector for coupling with a female connector. Plug 700 can be similar to plug 600 of FIGS. 6A and 6B, and plug 700 may include many of the same elements as plug 600. For example, plug 700 can include contact pads 752-754 (see, e.g., contact pads 652-654 of plug 600) and trace 764 (see, e.g., traces 664 of plug 600).

Unlike plug 600, plug 700 may include contact pad 751 that is a separate element from core structural member 710 (see, e.g., contact pad 651 which is a protrusion of structural member 650). However, even though contact pad 751 is a separate element from core structural member 710, contact pad 751 is coupled with structural member 710 through conductive path 771. Conductive path 771 can, for example, be a conductive via through insulating layer 720. Conductive path 771 can be formed from conductive material. In some embodiments, conductive path 771 can be formed from the same conductive material as contact pads and traces. For example, after insulating layer 720 is applied, through-holes can be created at specific points in layer 720 (e.g., by chemical or laser etching) and conductive material can be applied to fill the through-holes and create conductive path 771. Conductive path 771 can be any suitable structure for conducting electrical current through specific points in layer 720, and conductive path 771 can be formed using any suitable process.

Figure 8:
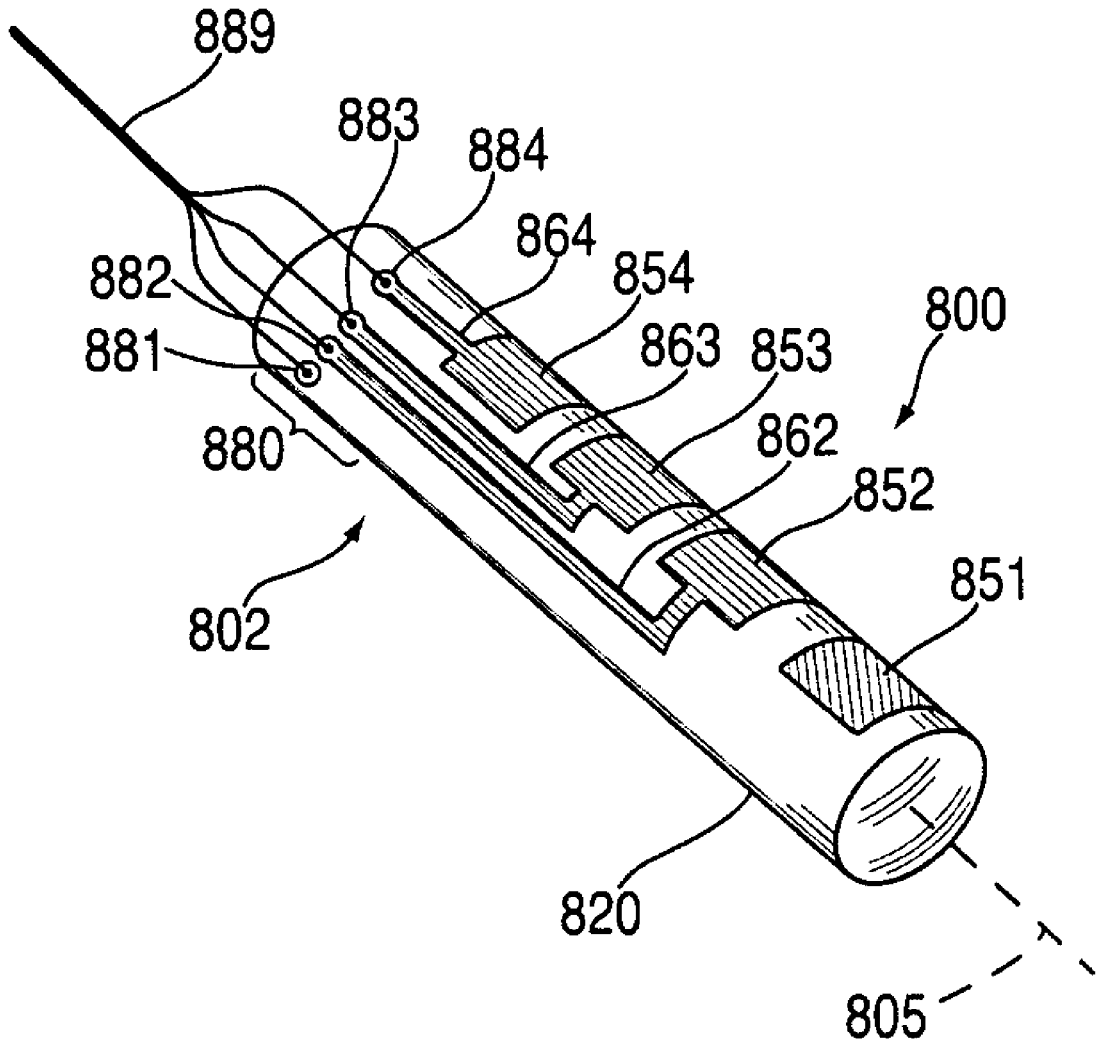
FIG. 8 is a perspective view of an illustrative plug in accordance with one embodiment of the invention.

In embodiments where a plug's core structural member serves as a conductive path, the plug's terminating point may include one or more conductive paths for coupling a cable, printed circuit board, or other suitable device (e.g., cable 189 of FIG. 1A) with the structural member. FIG. 8 includes plug 800 with termination point 880 in accordance with one embodiment. Plug 800 can be provided on any male connector for coupling with a female connector. Plug 800 can be similar to plug 600 of FIGS. 6A and 6B and plug 700 of FIG. 7. Plug 800 may include many of the same elements as plugs 600 and 700. For example, plug 800 can include contact pads 851-854 (see, e.g., contact pads 651-654 of plug 600) and traces 862-864 (see, e.g., traces 661-664 of plug 600). Each of traces 862-864 can extend along plug axis 805 towards proximal end 802 of plug 800. Plug 800 may include termination point 880 at proximal end 802 of the plug, and each of traces 862-864 may end at the termination point. Plug 800 may also include a core structural member that serves as a conductive path for contact pad 851 (see, e.g., conductive structural member 610 of FIG. 6B and conductive structural member 710 of FIG. 7). Termination point 880 may include a conductive path through insulating layer 820 to electrically couple the structural member of plug 800, and therefore contact pad 851, with a cable, printed circuit board, or other suitable device. The conductive path through insulating layer 820 may be substantially similar to conductive path 771 of plug 700, and the description of the latter can be applied to the former. In some embodiments, termination point 880 may include a conductive via and solder pad 881 to couple the conductive structural member of plug 800 with a line in cable 889. In some embodiments, rather than providing a conductive path through an insulating layer, a conductive structural member may simply extend beyond an insulating layer, and a line in a cable, printed circuit board, or other suitable device can be directly coupled with the exposed structural element. Similar to termination point 580 and traces 581-584 of plug 500, each of traces 862-864 on the surface of plug 800 can couple with a line in a cable, a trace on a printed circuit board, or any other suitable electrical line at termination point 880. For example, termination point 880 can include multiple solder pads 882-884 for coupling with various lines in cable 889. While the embodiment shown in FIG. 8 includes solder pads for coupling with lines in a cable, it is understood that any other suitable connection technique can be used to couple a termination point with a cable, printed circuit board, or other suitable device.

In some embodiments, a plug may electrically couple with a female connector when the plug is inserted into the female connector in the proper orientation. For example, contact pads 251-254 of plug 200 may be arranged in a straight line along one side of plug 200 and, for plug 200 to properly couple with a female connector, plug 200 may need to be inserted into the female connector so that the side of the plug with contact pads 251-254 is adjacent to an array of contacts in the female connector. Continuing the example, if plug 200 is inserted into the female connector in the wrong orientation, the plug may be unable to properly couple with the female connector because a contact in the female connector may overlap both a contact pad and a nearby trace on the plug (e.g., contact pad 254 and trace 263). Such embodiments are referred to herein as "orientation-specific" embodiments because the plug may need to be in a specific orientation to properly couple with a female connector. Plug 200, plug 400, and plug 600 may each be considered orientation-specific embodiments.

In some orientation-specific embodiments, a plug may be provided on a male connector with a mating surface having a feature (e.g., a key) to ensure that the plug inserts into a female connector in the proper orientation. For example, female connectors on electronic devices or the electronic devices themselves may have a particular geometry and a male connector may include a mating surface with a feature that correspondence to the particular geometry.

Figure 9:
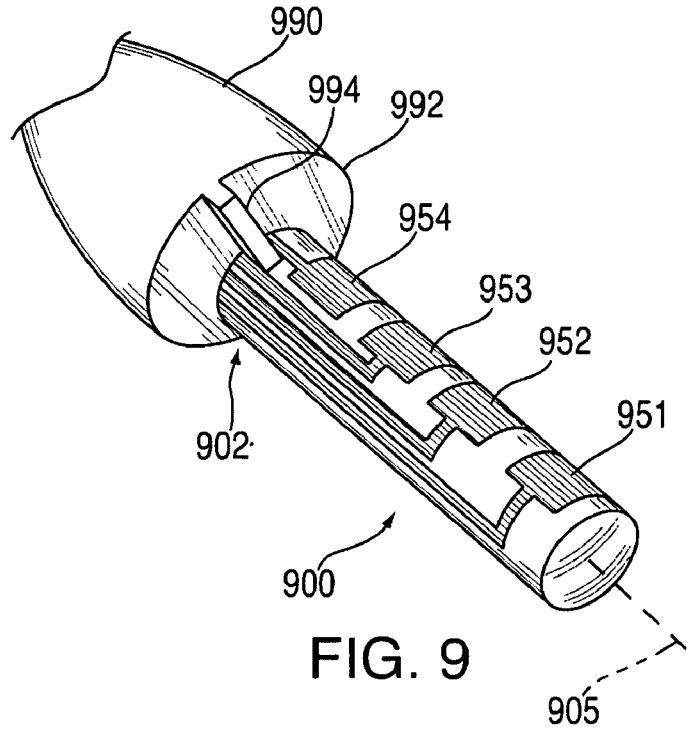
FIG. 9 is a perspective view of an illustrative connector incorporating a plug in accordance with one embodiment of the invention.

FIG. 9 includes plug 900 provided on a male connector with a key in accordance with one embodiment. Plug 900 may include protuberance 994 that can serve as a key to prevent plug 900 from coupling with a female connector in an improper orientation. Plug 900 may be any orientation-specific plug. For example, plug 900 may be substantially similar to plug 200 and may include contact pads 951-954 (see, e.g., contact pads 251-254).

Plug 900 may be provided on connector 990 for coupling connector 990 with a female connector. Connector 990 can include mating surface 992 adjacent to proximal end 902 of plug 900. When connector 990 couples with a female connector, mating surface 992 may abut a corresponding mating surface on the female connector. Accordingly, mating surface 992 may include protuberance 994 that may be any shape or size suitable for interfacing with a corresponding feature on a mating surface of a female connector. For example, protuberance 994 may be a raised ridge extending radially from plug axis 905 and a mating surface on a female connector may include a corresponding indentation extending radially from an aperture for receiving plug 900. With respect to the location of contact pads 951-954, protuberance 994 may be located in a specific location on mating surface 992 so that, when protuberance 994 interfaces with an indentation in a female connector, contact pads 951-954 may couple with an array of contacts in the female connector. Accordingly, plug 900 may only couple with a female connector in the proper orientation.

Figure 10:
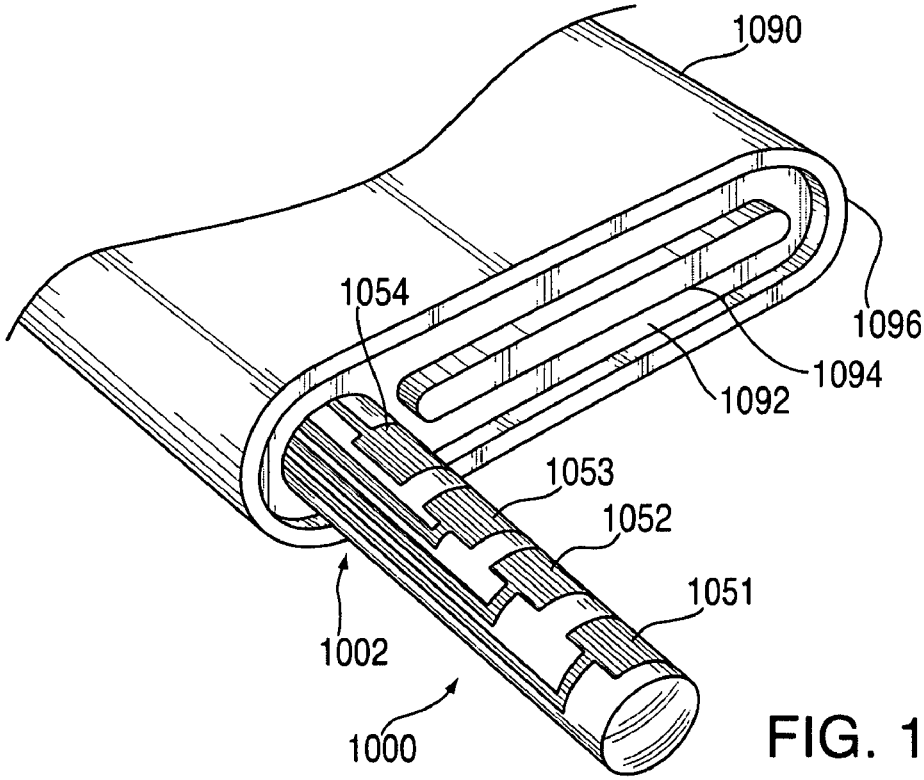
FIG. 10 is a perspective view of an illustrative connector incorporating a plug in accordance with one embodiment of the invention.

FIG. 10 includes plug 1000 provided on a male connector with a key in accordance with one embodiment. Plug 1000 may include protuberance 1094 and rim 1096 that can serve as a key to prevent plug 1000 from coupling with a female connector in an improper orientation. Plug 1000 may be any orientation-specific plug. For example, plug 1000 may be substantially similar to plug 200 and may include contact pads 1051-1054 (see, e.g., contact pads 251-254).

Plug 1000 may be provided on connector 1090 for coupling connector 1090 with a female connector. Connector 1090 may be substantially similar to connector 990 of FIG. 9. For example, connector 1090 may include mating surface 1092 adjacent to proximal end 1002 of plug 1000. However, connector 1090 may include protuberance 1094 and rim 1096 for preventing plug 1000 from coupling with a female connector in an improper orientation. When connector 1090 couples with a female connector included in an electronic device, mating surface 1092 may abut a surface of the electronic device that includes the female connector. Accordingly, mating surface 1092 may include protuberance 1094 and rim 1096 that may be any shape or size suitable for interfacing with a surface of the electronic device that includes a female connector. For example, protuberance 1094 may interface with an indentation in the surface of an electronic device that includes a female connector and the edge of the surface may fit within rim 1096.

In some situations, it may be desirable to have a plug that is not orientation specific. For example, an embodiment that is not orientation specific may be easier and quicker to couple because the connectors may not need to be aligned in order to couple together. In some embodiments, a connector that is not orientation specific may include circumferential contacts. For example, a contact could be a ring of conductive material around a circumference of a connector. In such embodiments, each contact can be coupled to a conductive path located below the outer surface of the plug so that it does not couple with any other contacts. For example, traces can be located below the outer surface of the plug and each trace can electrically couple with a single contact pad on the outer surface of the plug. In some embodiments, even though such conductive paths are below the outer surface, the paths may be near the outer surface to allow for a large core structural member.

FIGS. 11A-11D include plug 1100 with traces below but near the outer surface of the plug in accordance with one embodiment. Plug 1100 can be provided on any male connector for coupling with a female connector. Compared to plug 200 of FIGS. 2A and 2B, plug 1100 can have a similar shape and size and can perform similar functions (e.g., coupling with a female connector). Plug 1100 can include structural member 1110 that may be substantially similar to structural member 210 of plug 200, although structural member 1110 may be smaller than structural member 210. However, plug 1100 can include different insulating layers, contact pads and traces. For example, plug 1100 can include, in order from inner core to outer surface, a core structural member, an inner insulating layer, one or more conductive paths, an outer insulating layer, and contact pads.

Plug 1100 can include outer insulating layer 1130 that can be formed from a dielectric material. Outer insulating layer 1130 may be formed from ceramic, polycarbonate, polyethylene, polystyrene, or any other suitable dielectric material. Outer insulating layer 1130 can, for example, insulate any contact pads on the outer surface of plug 1100 from each other as well as any conductive paths below the surface of plug 1100.

Plug 1100 can include contact pads 1151, 1152, 1153, and 1154 on the outer surface of plug 1100. Each of contact pads 1151-1154 may have a ring or cylindrical shape that extends completely around the circumference of plug 1100. Contact pads 1151-1154 can be formed from a conductive material. For example, contact pads 1151-1154 may be formed by depositing a conductive material onto outer insulating layer 1130. Contact pads 1151-1154 may be sufficiently thick enough to withstand forces from mating with a female connector (e.g., frictional forces from inserting plug 1100 in a jack and withdrawing plug 1100 from a jack). In some embodiments, contact pads 1151-1154 may protrude from the outer surface of outer insulating layer 1130. In other embodiments, contact pads 1151-1154 may be substantially flush with the outer surface of outer insulating layer 1130. For example, one or more indentations can be provided in outer insulating layer 1130 (e.g., by chemical or laser etching), and conductive material can be deposited in the indentations to create contact pads 1151-1154 substantially flush with the outer surface of outer insulating layer 1130. Each of contact pads 1151-1154 can be sized and shaped to mate with a corresponding contact in a female connector (e.g., a jack). Moreover, the array of contact pads 1151-1154 may be arranged to mate with an array of contacts in a female connector. For example, contact pads 1151-1154 may be arranged in an order along plug axis 1105 that corresponds to an array of contacts in a female connector.

Plug 1100 may not be an orientation-specific embodiment. All of contacts pads 1151-1154 extend completely around the circumference of plug 1100 at a particular location on plug axis 1105. Therefore, each of contact pads 1151-1154 will electrically couple with a particular contact in a female connector regardless of the orientation of plug 1100 when it is inserted into the female connector. Because plug 1100 may not be an orientation-specific embodiment, plug 1100 may be provided on a connector without any special features to ensure that plug 1100 is inserted into a female connector in a particular orientation (see, e.g., connector 990 with protuberance 994 and connector 1090 with protuberance 1094 and rim 1096).

Figure 11A:
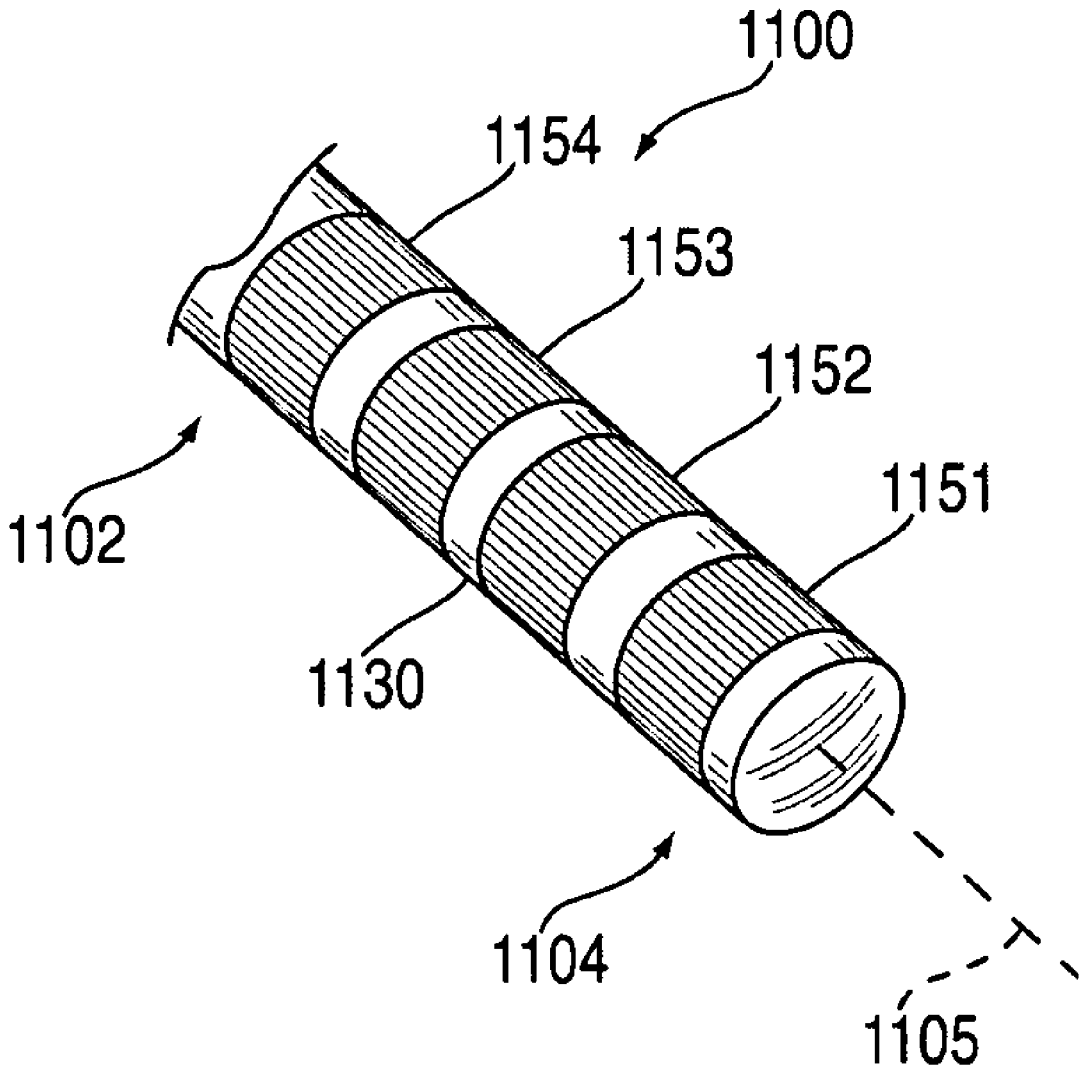
FIG. 11A is a perspective view of an illustrative plug in accordance with one embodiment of the invention.
Figure 11B:
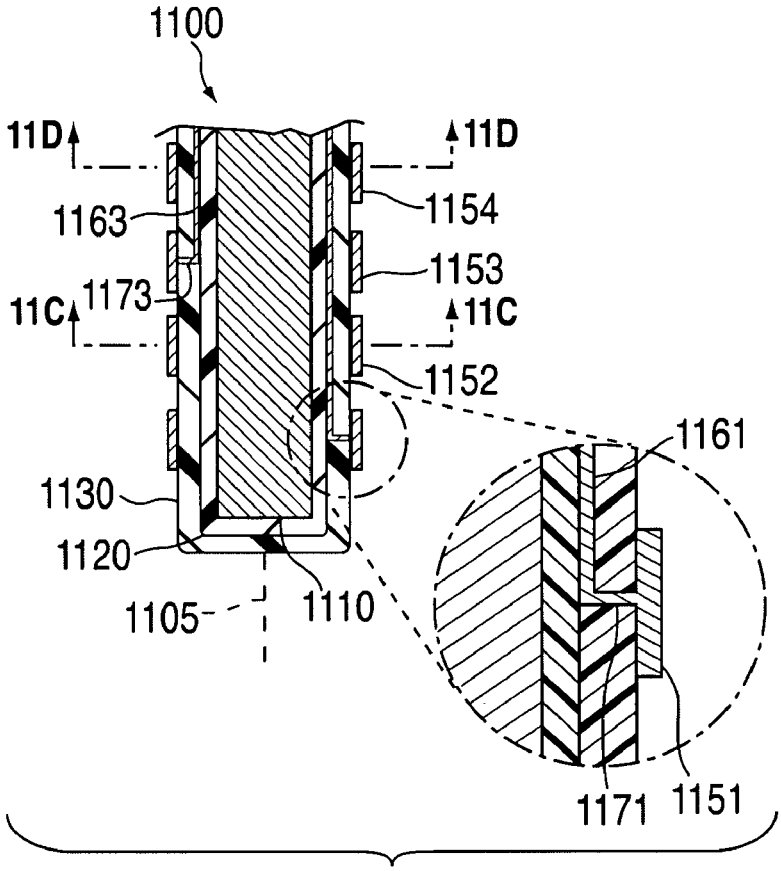
FIG. 11B is a cross-sectional view of an illustrative plug in accordance with one embodiment of the invention.
Figure 11C:
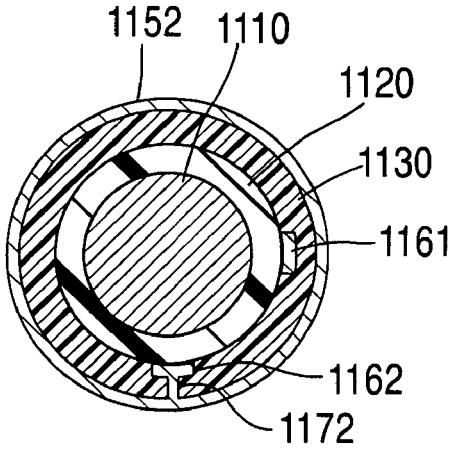
FIG. 11C is a cross-sectional view of an illustrative plug in accordance with one embodiment of the invention.
Figure 11D:
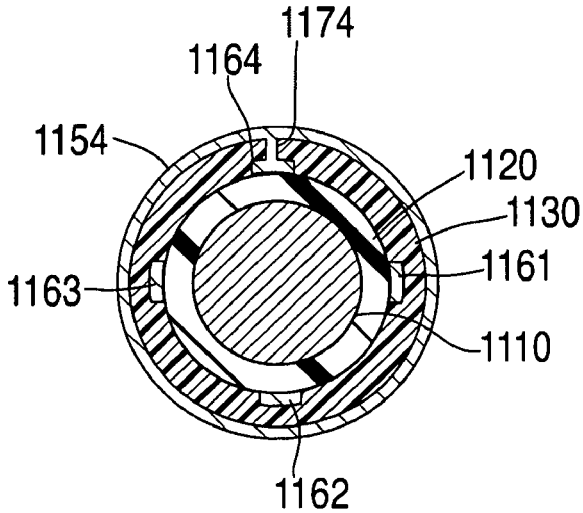
FIG. 11D is a cross-sectional view of an illustrative plug in accordance with one embodiment of the invention.

As seen in the cross-section views of FIGS. 11B-11D, plug 1100 may include an inner insulating layer 1120 between structural member 1110 and outer insulating layer 1130. Inner insulating layer 1120 may be formed from dielectric material. For example, inner insulating layer 1120 may be formed from ceramic, polycarbonate, polyethylene, polystyrene, or any other suitable dielectric material. In some embodiments, inner insulating layer 1120 may be formed from the same material as outer insulating layer 1130. Inner insulating layer 1120 can, for example, provide a platform for one or more conductive paths below the surface of plug 1100 (e.g., below outer insulating layer 1130) but above structural member 1110.

Plug 1100 may include traces below the outer surface of plug 1100. For example, as seen in FIG. 11D, plug 1100 may include traces 1161-1164 between inner insulating layer 1120 and outer insulating layer 1130. Inner insulating layer 1120 may insulate each of traces 1161-1164 from other traces and structural member 1110. Traces 1161-1164 can be formed from a conductive material. For example, traces 1161-1164 can be formed by depositing a conductive material onto inner insulating layer 1120 before outer insulating layer 1130 is applied. After outer insulating layer 1130 is in place, traces 1161-1164 may electrically couple with contact pads above layer 1130 through one or more conductive paths extending through layer 1130. For example, as seen in FIG. 11B, trace 1161 may electrically couple with contact pad 1151 through conductive path 1171, and trace 1163 may electrically couple with contact pad 1153 through conductive path 1173. Continuing the example, as seen in FIG. 11C, trace 1162 may electrically couple with contact pad 1152 through conductive path 1172 and, as seen in FIG. 11D, trace 1164 may electrically couple with contact pad 1154 through conductive path 1174. Like contact pads 1151-1154 and traces 1161-1164, conductive paths 1171-1174 can be formed from conductive material. For example, after outer insulating layer 1130 is applied, through-holes can be created at specific points in layer 1130 (e.g., by chemical or laser etching) and conductive material can be applied to fill the through-holes and create conductive paths 1171-1174. Conductive paths 1171-1174 can be any suitable structures for conducting electrical current through specific points in layer 1130, and conductive paths 1171-1174 can be formed using any suitable process. Outer insulating layer 1130 may insulate each of traces 1161-1164 from other traces and any of conductive paths 1171-1174 or any of contact pads 1151-1154 to which the traces are not intentionally coupled.

In some embodiments, each of traces 1161-1164 can be located the same distance from axis 1105 (e.g., at the same radius or radial layer) as the other traces. For example, insulating layer 1120 may be centered around plug axis 1105 so that traces 1161-1164 are the same radial distance from plug axis 1105 when deposited on insulating layer 1120. In other words, traces 1161-1164 may all be on the same radial layer.

Figure 12:
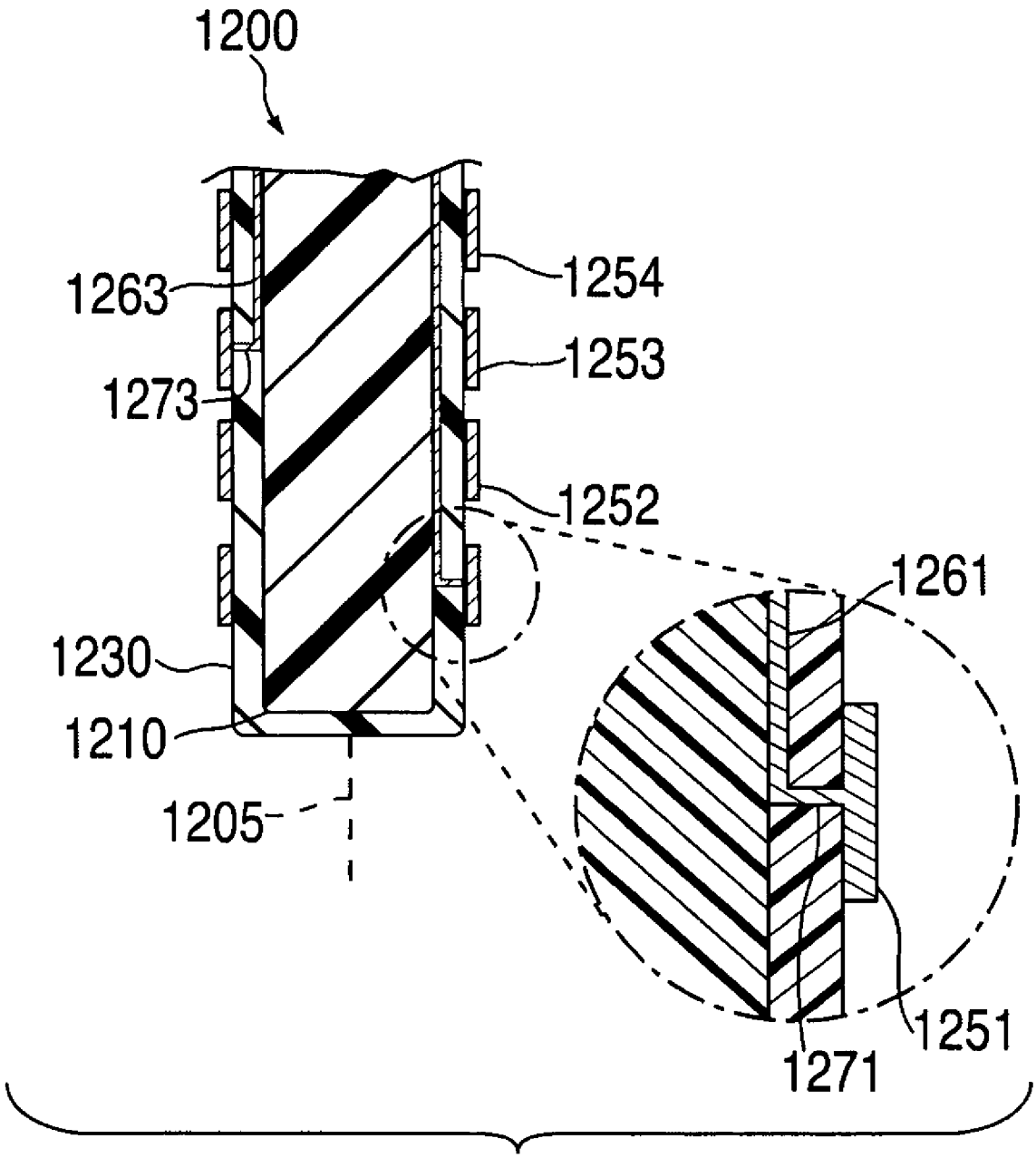
FIG. 12 is a cross-sectional view of an illustrative plug in accordance with one embodiment of the invention.

In some embodiments, a plug with conductive paths below but near the surface of the plug may include a structural member with insulating properties (see, e.g., dielectric structural member 410 of plug 400) rather than a structural member and an inner insulating layer covering the structural member (see, e.g., structural member 1110 and insulating layer 1120 of plug 1100). FIG. 12 includes plug 1200 with dielectric structural member 1210 in accordance with one embodiment. Plug 1200 can be provided on any male connector for coupling with a female connector. Plug 1200 can be similar to plug 1100 of FIGS. 11A-D, and plug 1200 may include many of the same elements as plug 1100. For example, plug 1200 can include contact pads 1251-1254 (see, e.g., contact pads 1151-1154 of plug 1100), traces 1261 and 1263 (see, e.g., traces 1161 and 1163 of plug 1100), and conductive paths 1271 and 1273 (see, e.g., conductive paths 1171 and 1173 of plug 1100).

Unlike plug 1100, plug 1200 may not include a separate core structural member and inner insulating layer covering the structural member. For example, plug 1200 may include core structural member 1210 that can provide structural integrity while also forming an insulating surface for receiving conductive material. A separate insulating layer may not be necessary if structural member 1210 is formed from a dielectric material. For example, structural member 1210 may be formed from ceramic, polycarbonate, polyethylene, polystyrene, or any other suitable dielectric material. In some embodiments, structural member 1210 may be formed from a rigid dielectric material that will increase the structural integrity of plug 1200. In some embodiments, structural member 1210 may be a solid piece of rigid dielectric material that is formed by any suitable manufacturing technique. In some embodiments, structural member 1210 may be shaped to increase its structural integrity. For example, structural member 1210 may have a length, width, length-to-width ratio, or any other dimension or characteristic that provides structural integrity. Structural member 1210 may also provide structural integrity by acting as the core or inner member of plug 1200.

Figure 13:
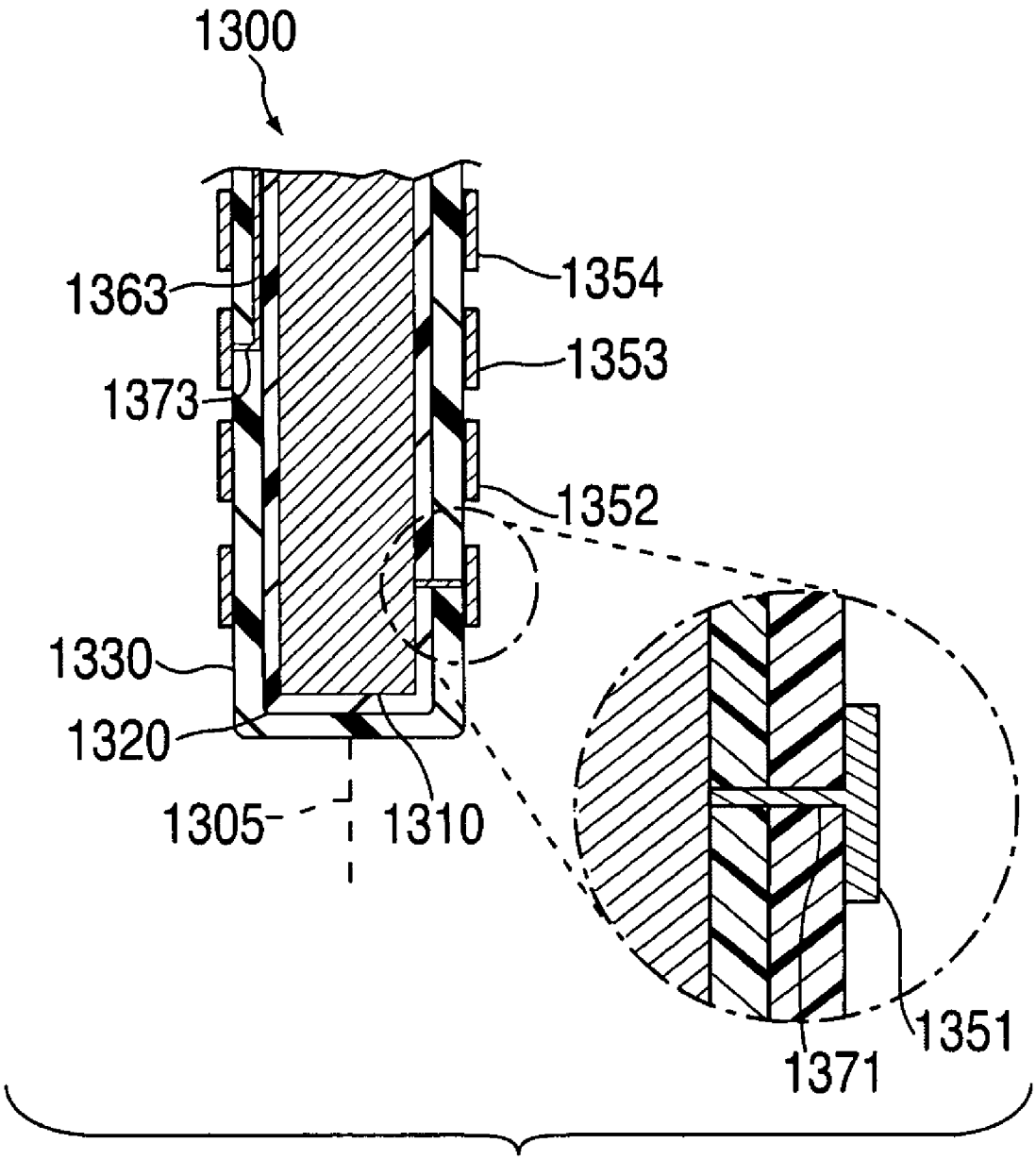
FIG. 13 is a cross-sectional view of an illustrative plug in accordance with one embodiment of the invention.

In some embodiments, a plug with conductive paths below but near the surface of the plug may include a structural member that functions as a conductive path for a contact pad. For example, a conductive path through multiple insulating layers can electrically couple a contact pad with a structural element (see, e.g., protrusion 612 of plug 600 and conductive path 771 of plug 700), and conductive paths through the outermost insulating layer (see, e.g., conductive paths 1172-1174 of plug 1100) can electrically couple each of the more proximal contact pads with a different trace below the outer surface of the plug that extends towards the proximal end of the plug. FIG. 13 includes plug 1300 with structural member 1310 functioning as a conductive path in accordance with one embodiment. Plug 1300 can be provided on any male connector for coupling with a female connector. Plug 1300 can be similar to plug 1100 of FIGS. 11A-D, and plug 1300 may include many of the same elements as plug 1100. For example, plug 1200 can include contact pads 1351-1354 (see, e.g., contact pads 1151-1154 of plug 1100), trace 1363 (see, e.g., trace 1163 of plug 1100), and conductive path 1373 (see, e.g., conductive path 1173 of plug 1100).

Unlike plug 1100, plug 1300 may include a conductive path coupling the core structural member of the plug with a contact. For example, plug 1300 may include conductive path 1371 through outer insulating layer 1330 and inner insulating layer 1320. Accordingly, plug 1300 may not include a conductive path for contact pad 1351 between inner insulating layer 1320 and outer insulating layer 1330 because that electrical signal is being routed through conductive structural member 1310.

Traces 1161-1164 may extend at least partially along plug axis 1105 towards proximal end 1102 of plug 1100. For example, trace 1161 may couple with contact pad 1151, through conductive path 1171, and extend directly along plug axis 1105 towards proximal end 1102. In the embodiment shown in FIGS. 11B-11D, each of traces 1161-1164 may extend directly along plug axis 1105 towards proximal end 1102 because conductive paths 1171-1174 are each on different sides of plug 1100. However, in embodiments, where two or more conductive paths are on the same side of a plug, the trace coupled with the more distal conductive path may extend at least partially around the plug axis to avoid the other conductive path and trace before extending along the plug axis towards the proximal end of the plug.

Figure 14:
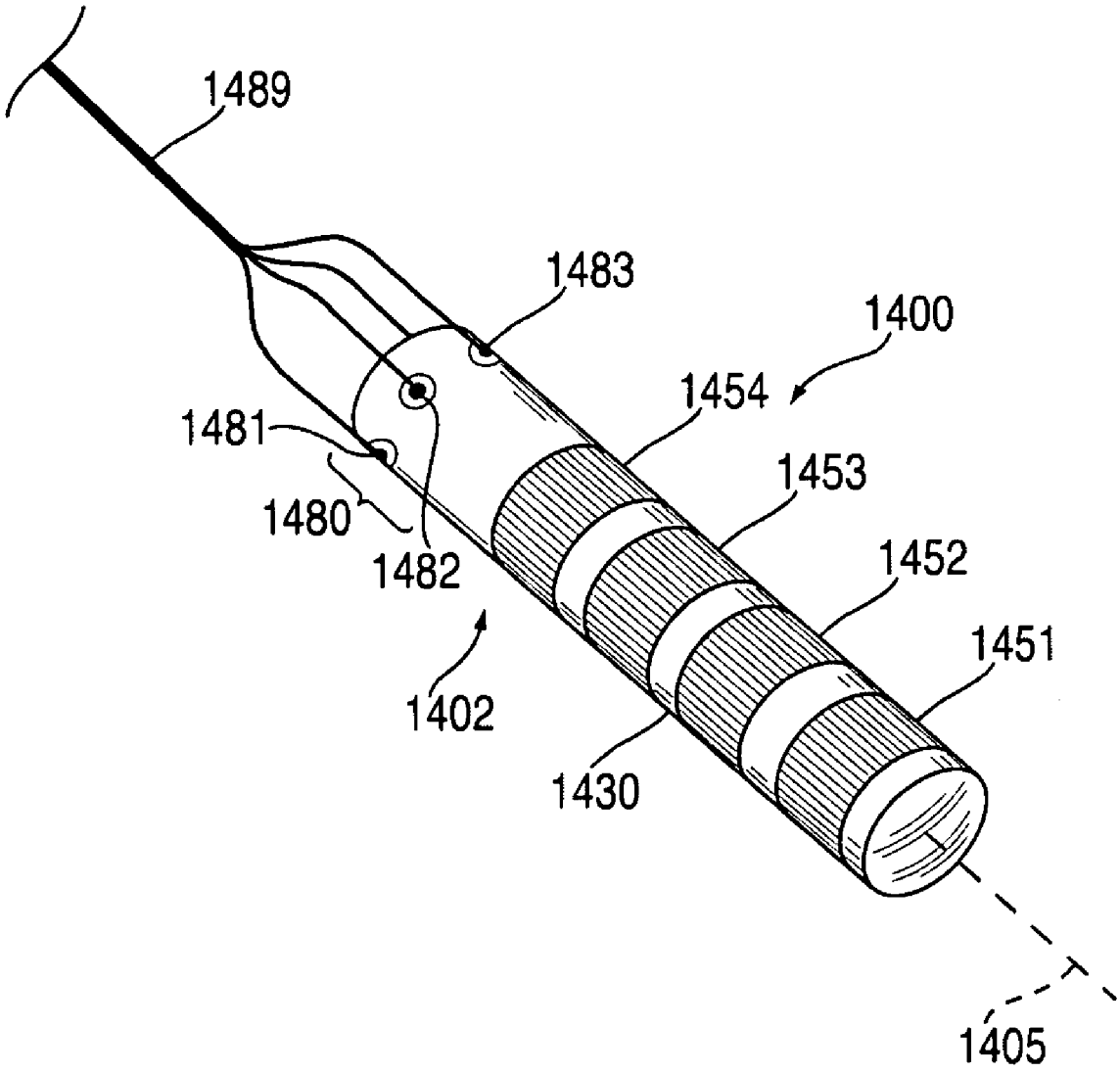
FIG. 14 is a perspective view of an illustrative plug in accordance with one embodiment of the invention.

In embodiments where conductive paths are located below the surface of the plug, the plug's terminating point may include one or more conductive paths for coupling a cable, printed circuit board, or other suitable device (e.g., cable 189 of FIG. 1A) with the conductive paths below the surface. FIG. 14 includes plug 1400 with termination point 1480 in accordance with one embodiment. Plug 1400 can be provided on any male connector for coupling with a female connector. Plug 1400 can be similar to plug 1100 of FIGS. 11A-11D, plug 1200 of FIG. 12, and plug 1300 of FIG. 13. Plug 1400 may include many of the same elements as plugs 1100, 1200, and 1300. For example, plug 1400 can include contact pads 1451-1454 (see, e.g., contact pads 1151-1154 of plug 1100) and traces underneath the outer surface of the plug (see, e.g., traces 1161-1164 of plug 1100, traces 1261 and 1263 of plug 1200, and traces 1363 of plug 1300). Each of the traces underneath the surface of plug 1400 can extend along plug axis 1405 towards proximal end 1402 of plug 1400. Plug 1400 may include termination point 1480 at proximal end 1402 of the plug. Termination point 1480 may include conductive paths through insulating layer 1430 to electrically couple the traces underneath the surface of plug 1400 with a cable, printed circuit board, or other suitable device. The conductive paths through insulating layer 1430 may be substantially similar to conductive path 771 of plug 700, and the description of the latter can be applied to the former. In some embodiments, termination point 1480 may include conductive vias and solder pads 1481-1483 to couple traces under the surface of plug 1400 with lines in cable 1489. In embodiments where a plug's core structural member serves as a conductive path (see, e.g., structural member 1310 of plug 1300), termination point 1480 can include a conductive path through all insulating layers (see, e.g., outer insulating layer 1330 and inner insulating layer 1320 of plug 1300) to electrically couple the conductive structural member with a cable, printed circuit board, or other suitable device. Moreover, rather than providing a conductive path through an insulating layer, the structural member, inner insulating layer and traces may simply extend beyond the outer insulating layer in some embodiments, and a line in a cable, printed circuit board, or other suitable device can be directly coupled with the exposed traces. While the embodiment shown in FIG. 14 include solder pads for coupling with lines in a cable, it is understood that any other suitable connection technique can be used to couple a termination point with a cable, printed circuit board, or other suitable device.

Figure 15:
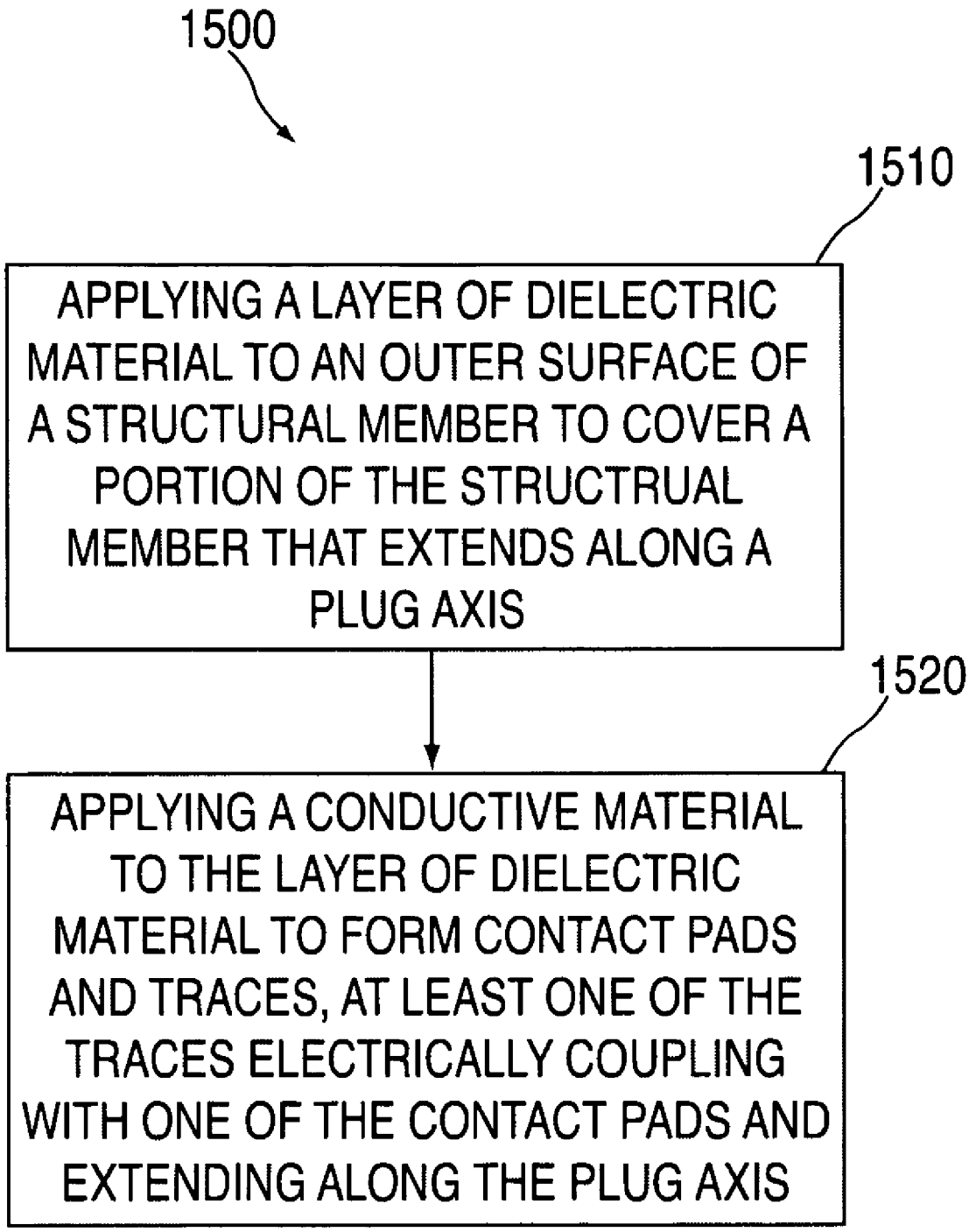
FIG. 15 is a flowchart of an illustrative process for forming a plug in accordance with one embodiment of the invention.

FIG. 15 includes process 1500 for manufacturing a plug in accordance with one embodiment. Process 1500 can be used to form an orientation-specific plug such as, for example, plug 200 of FIGS. 2A and 2B, plug 400 of FIG. 4, or plug 600 of FIGS. 6A and 6B. Prior to performing process 1500, a structural member (see, e.g., structural member 210 of plug 200 or structural member 610 of plug 600) can be formed. For example, a structural member can be formed by turning, machining, forging, casting, any other suitable manufacturing technique, or any combination thereof.

At block 1510, a layer of dielectric material may be applied to an outer surface of a structural member to cover a portion of the structural member that extends along a plug axis. For example, a layer of dielectric material (see, e.g., insulating layer 220) can be applied to the outer surface of a structural member (see, e.g., structural member 210) to cover the portion of the member that extends along the plug axis towards the distal end of the plug (see, e.g., plug axis 205 and distal end 204). In some embodiments, a layer of dielectric material can be applied to the entire outer surface of a structural member to cover the entire structural member. A layer of dielectric material may be applied to an outer surface of a structural member using any suitable technique at block 1510. For example, dielectric material may be sprayed or painted onto the outer surface of the structural member to create a layer. In another example, the structural member may be at least partially dipped into a pool of liquid dielectric material and then, after the member is removed from the pool, heat may be applied to harden the liquid coating and form a layer.

At block 1520, a conductive material may be applied to the layer of dielectric material to form contact pads and traces. For example, a conductive material can be applied to the surface of the layer of dielectric material (see, e.g., insulating layer 220) to form contact pads for coupling with a female connector (see, e.g., contact pads 251-254) and traces that serve as conductive paths (see, e.g., traces 261-264). At least one of the traces formed at block 1520 can electrically couple with one of the contact pads and extend along the plug axis (see, e.g., trace 261 coupling with contact pad 251 and extending along plug axis 205). In some embodiments, at least one of the traces formed at block 1520 may extend at least partially around the plug in addition to extending along the plug axis (see, e.g., trace 261 extending partially around plug 200 to avoid the other contact pads and traces).

Any suitable technique for applying a conductive material can be used to form contact pads and traces at block 1520. For example, a conductive material can be applied using a technique that includes depositing, sputtering, painting, gluing, adhering, spray-coating, immersion-coating, any other suitable technique, or any combination thereof. Moreover, in some embodiments, contact pads may be formed at block 1520 using a technique different from the technique used to form traces at block 1520.

In some embodiments, a conductive material can be applied to the layer of dielectric material to form contact pads and/or traces by sputter deposition or physical vapor deposition (PVD). In some embodiments, the layer of dielectric material can be selectively etched in locations for contact pads and/or traces and the etched areas can be plated with conductive material (e.g., a metal or an alloy) at block 1520. For example, the layer of dielectric material can be selectively etched using a laser. In some embodiments, one or more indentations may be created in the layer of dielectric material before applying conductive material at block 1520. For example, one or more indentations may be etched into the dielectric material at the locations for contact pads and traces and conductive material can be applied to fill in the indentations and form contact pads and traces.

In some embodiments, a mask with apertures corresponding to the locations for contact pads and/or traces can applied to the layer of dielectric material at block 1520. Conductive material can then be applied over the mask, and the mask can be removed to form contact pads and/or traces. In other embodiments, a uniform coat of conductive material can be applied to the layer of dielectric material at block 1520, and then sections of the conductive material can be removed (e.g., using chemical or laser etching) to form contact pads and/or traces. In some embodiments, conductive ink can be printed in a pattern on the layer of dielectric material to form contact pads and/or traces at block 1520. For example, a printer can print conductive ink onto the layer of dielectric material and an oven can be used to heat the structural member and harden the conductive ink.

In some embodiments, the contact pads and traces formed at block 1520 may have the same thickness. For example, the contact pads (see, e.g., contact pads 251-254) and traces (see, e.g., traces 261-264) may protrude the same distance from the dielectric material (see, e.g., insulating layer 220). In other embodiments, the contact pads may be thicker than the traces because the contact pads may need to withstand forces from mating with a female connector (e.g., frictional forces from inserting plug 200 in a jack and withdrawing plug 200 from a jack).

In some embodiments, process 1500 can include applying multiple layers of material to form contact pads and/or traces. For example, process 1500 can include providing multiple layers of the same conductive material to form contact pads and/or traces. In some embodiments, process 1500 can include providing multiple layers of different materials to form contact pads and/or traces. For example, process 1500 can include applying a first type of material to form a bottom layer of contact pads and/or traces and then applying a second type of material to form a top layer of contact pads and/or traces. In one example, the first type of material can be a material that forms a texture for receiving the second type of material that serves as the primary conductor. In another example, the first type of material can be a primary conductor and the second type of material can be relatively smooth to reduce frictional forces when the plug is inserted and removed from jacks.

A trace formed at block 1520 may electrically couple with one of the contact pads using any suitable physical connection. In some embodiments, a trace may be a continuous extension of a contact pad and may, therefore, be electrically coupled with the contact pad. In some embodiments, a trace may abut the edge of a contact pad to electrically couple with the contact pad. In some embodiments, a contact pad may overlap at least a portion of a trace to electrically couple with the trace. For example, conductive material may be applied to form the trace before conductive material is applied to form the contact pad, and the contact pad may overlap at least a portion of the trace.

In some embodiments, a plug can include a structural member with insulating properties (see, e.g., structural member 410 of plug 400). Accordingly, a process for forming a plug in accordance with such embodiments may not include applying a layer of dielectric material to an outer surface of a structural member (see, e.g., block 1510). For example, a process for forming a plug with a structural member having insulating properties (see, e.g., structural member 410 of plug 400) may simply include applying a conductive material to the structural member to form contact pads and traces. At least one of the traces may be electrically coupled with one of the contact pads and extend along a plug axis.

Figure 16:
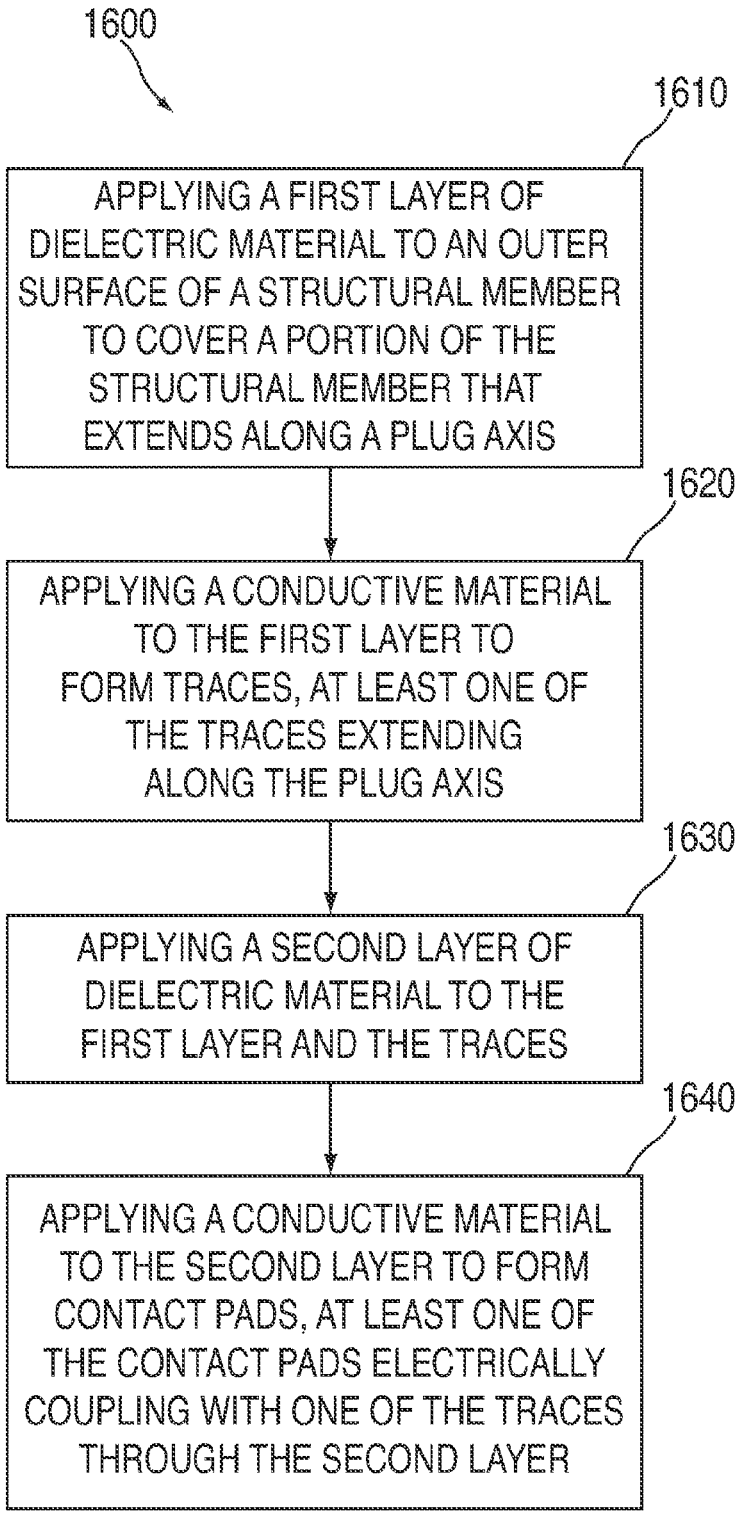
FIG. 16 is a flowchart of an illustrative process for forming a plug in accordance with one embodiment of the invention.

FIG. 16 includes process 1600 for manufacturing a plug in accordance with one embodiment. Process 1600 can be used to form a plug that is not orientation-specific. For example, process 1600 can be used to form plug 1100 of FIGS. 11A-11D. Prior to performing process 1600, a structural member (see, e.g., structural member 210 of plug 200 or structural member 1110 of plug 1100) can be formed. For example, a structural member can be formed by turning, machining, forging, casting, any other suitable manufacturing technique, or any combination thereof.

At block 1610, a first layer of dielectric material (see, e.g., layer 1120 of plug 1100) may be applied to an outer surface of a structural member to cover a portion of the structural member that extends along a plug axis. Block 1610 may be substantially similar to block 1510 of process 1500 and the previous description of the latter can be applied to the former.

At block 1620, a conductive material can be applied to the first layer of dielectric material to form traces. At least one of the traces formed at block 1620 may extend along the plug axis. For example, a conductive material can be applied on top of the first layer of dielectric material (see, e.g., layer 1120 of plug 1100) to form traces that serve as conductive paths along the plug axis (see, e.g., traces 1161-1164 extending along plug axis 1105). In some embodiments, at least one of the traces formed at block 1620 may extend at least partially around the plug in addition to extending along the plug axis. Any suitable method for applying a conductive material can be used to form traces at block 1620 (see, e.g., discussion related to applying a conductive material to form contact pads and traces at block 1520 of process 1500).

At block 1630, a second layer of dielectric material (see, e.g., layer 1130 of plug 1100) can be applied over the first layer and the traces. In some embodiments, the second layer of dielectric material can be applied in block 1630 using a method substantially similar to the method used to apply dielectric material in block 1510 of process 1500. Accordingly, the previous description of applying dielectric material in block 1510 can be applied to applying a second layer of dielectric material in block 1630. After block 1630, the traces formed at block 1620 may be below the surface of the plug (see, e.g., traces 1161-1164 below layer 1130).

At block 1640, a conductive material can be applied to the second layer of dielectric material to form contact pads (see, e.g., contact pads 1151-1154 of plug 1100). For example, a conductive material can be applied on top of the second layer of dielectric material (see, e.g., layer 1130) to form contact pads for coupling with a female connector (see, e.g., contact pads 1151-1151). Any suitable method for applying a conductive material can be used to form contact pads at block 1640 (see, e.g., discussion related to applying a conductive material to form contact pads and traces at block 1520 of process 1500).

At least one of the contact pads formed at block 1640 can electrically couple with one of the traces formed at block 1620 through the second layer of dielectric material. For example, one or more conductive paths (see, e.g., conductive paths 1171-1174) may extend through the second layer of dielectric material to electrically couple a contact pad with one of the traces. Like the traces formed at block 1620 and the contact pads formed at block 1640, conductive paths through the second layer of dielectric material can be formed from conductive material. For example, after a second layer of dielectric material is applied at block 1630, through-holes can be created at specific points in the second layer (e.g., by chemical or laser etching) and conductive material can be applied to fill the through-holes and create conductive paths. At block 1640, conductive material can be applied to create contact pads on top of such conductive paths through the second layer of dielectric material. It is understood that any suitable structure for conducting electrical current through specific points in a dielectric layer can function as a conductive path through the second layer of dielectric material. Moreover, such conductive paths can be formed using any suitable process.

While the above description occasionally refers to embodiments of audio plugs and methods for manufacturing audio plugs, it is understood that the plug and methods of manufacture can be applied to any type of plug for transmitting any type of electrical signal. For example, the above description can be applied to plugs for transmitting electrical power, data, audio, or any combination of the above between electronic devices.

The previously described embodiments are presented for purposes of illustration and not of limitation. It is understood that one or more features of an embodiment can be combined with one or more features of another embodiment to provide systems and/or methods without deviating from the spirit and scope of the invention.

The above described embodiments are presented for purposes of illustration and not of limitation, and the present invention is limited only by the claims which follow.

What is claimed is:

1. An elongated plug extending from a proximal end to a distal end, the plug comprising:

a structural member extending along a plug axis;

contact pads positioned over an outer surface of the structural member;

traces positioned over the outer surface of the structural member, at least one of the traces electrically coupling with one of the contact pads and extending along the plug axis towards the proximal end; and an insulating layer disposed between the structural member and the contact pads and traces.

2. The plug of claim 1, wherein:

the traces include a first trace located at a radial distance from the plug axis; and all other traces are located at the same radial distance from the plug axis.

3. The plug of claim 1, wherein the contact pads are arranged on the outer surface of the plug in a straight line parallel with the plug axis.

4. The plug of claim 1, further comprising:

a housing positioned over the proximal end of the plug, wherein the structural member extends into the housing.

5. The plug of claim 1, wherein the insulating layer encapsulates the structural member.

6. The plug of claim 1, wherein the contact pads protrude from the insulating layer.

7. The plug of claim 1, wherein the contact pads have a thickness that is greater than a thickness of the traces.

8. The plug of claim 1, wherein each of the contact pads has an outer surface that is flush with an outer surface of the insulating layer.

9. The plug of claim 8, wherein:

the insulating layer comprises indentations; and the contact pads include conductive material deposited in the indentations.

10. An elongated plug extending from a proximal end to a distal end, the plug comprising:

a structural member extending along a plug axis, the structural member being conductive:

contact pads positioned over an outer surface of the structural member, one of the contact pads being electrically coupled with the structural member; and traces positioned over the outer surface of the structural member, at least one of the traces electrically coupling with one of the contact pads and extending along the plug axis towards the proximal end.

11. An elongated plug extending from a proximal end to a distal end, the plug comprising:

a structural member extending along a plug axis;

contact pads positioned over an outer surface of the structural member; and traces positioned over the outer surface of the structural member, at least one of the traces electrically coupling with one of the contact pads and extending along the plug axis towards the proximal end, wherein at least one of the traces extends at least partially around the plug axis before extending along the plug axis.

12. The plug of claim 11, wherein:

the structural member has insulating properties; and the contact pads and traces are disposed on an outer surface of the structural member.

13. A connector comprising:

elongated plug extending from a proximal end to a distal end and comprising:

a structural member extending along a plug axis;

contact pads positioned over an outer surface of the structural member; and traces positioned over the outer surface of the structural member, at least one of the traces electrically coupling with one of the contact pads and extending along the plug axis towards the proximal end; and a protuberance adjacent to the proximal end of the plug, the protuberance being shaped to interface with a female connector so that the plug inserts into the female connector in a proper orientation.

14. An elongated plug extending from a proximal end to a distal end, the plug comprising:

a structural member extending along a plug axis;

a first insulating layer disposed over an outer surface of the structural member;

traces disposed on the first insulating layer, at least one of the traces extending along the plug axis;

a second insulating layer disposed over the first insulating layer and the traces; and contact pads disposed on the second insulating layer, at least one of the contact pads electrically coupling with one of the traces through the second insulating layer.

15. The plug of claim 14, wherein:

the structural member is conductive; and one of the contact pads is electrically coupled with the structural member.

16. The plug of claim 14, wherein each of the traces extends directly towards the proximal end in a direction parallel to the plug axis.

17. The plug of claim 14, wherein:

the traces include a first trace located at a radial distance from the plug axis; and all other traces are located at the same radial distance from the plug axis.

18. The plug of claim 14, wherein the first insulating layer and the second insulating layer are formed from a different material.

19. The plug of claim 14, wherein each of the contact pads is in a ring shape that extends completely around the plug axis.

20. The plug of claim 14, wherein the at least one of the contact pads electrically couples with one of the traces through a conductive path extending radially from the plug axis through the second insulating layer.

21. An elongated plug extending from a proximal end to a distal end, the plug comprising:

a structural member extending along a plug axis;

contact pads positioned on an outer surface of the plug;

traces positioned a uniform radial distance from the plug axis, at least one of the traces electrically coupling with one of the contact pads and extending along the plug axis towards the proximal end; and an insulating layer disposed between the structural member and the contact pads and traces.

22. The plug of claim 21, further comprising:

a housing positioned over the proximal end of the plug, wherein the structural member extends into the housing.

23. The plug of claim 21, wherein the insulating layer encapsulates the structural member.

24. The plug of claim 21, wherein the contact pads protrude from the outer surface of the plug.

25. The plug of claim 21, wherein the contact pads have a thickness that is greater than a thickness of the traces.

26. The plug of claim 21, wherein each of the contact pads has an outer surface that is flush with a portion of the plug's outer surface.

27. The plug of claim 26, wherein:

the insulating layer comprises indentations; and the contact pads include conductive material deposited in the indentations.

28. An elongated plug extending from a proximal end to a distal end, the plug comprising:

a structural member extending along a plug axis;

contact pads positioned on an outer surface of the plug; and traces positioned a uniform radial distance from the plug axis, at least one of the traces electrically coupling with one of the contact pads and extending along the plug axis towards the proximal end, wherein the traces are disposed under the outer surface of the plug.

29. An elongated plug extending from a proximal end to a distal end, the plug comprising:

a structural member extending along a plug axis;

contact pads positioned on an outer surface of the plug;

traces positioned a uniform radial distance from the plug axis, at least one of the traces electrically coupling with one of the contact pads and extending along the plug axis towards the proximal end; and an insulating layer disposed between the traces and the contact pads.

* * * * *

UNITED STATES PATENT AND TRADEMARK OFFICE

CERTIFICATE OF CORRECTION

PATENT NO. : 7,927,151 B2
APPLICATION NO. : 12/479404
DATED : April 19, 2011
INVENTOR(S) : Christopher D. Prest et al.

It is certified that error appears in the above-identified patent and that said Letters Patent is hereby corrected as shown below:

On sheet 14 of 15, in Figure 15, Ref. Numeral 1510, line 4, delete "STRUCTRUAL" and insert -- STRUCTURAL --, therefor.

In column 18, line 52, in claim 10, delete "conductive:" and insert -- conductive; --, therefor.

Signed and Sealed this
Twenty-ninth Day of November, 2011

David J. Kappos

David J. Kappos
*Director of the United States Patent and Trademark Office*